US010641479B2

(12) United States Patent
Schiavi

(10) Patent No.: US 10,641,479 B2
(45) Date of Patent: May 5, 2020

(54) SYSTEM FOR CREATING MOVEMENT USING A HEAT SOURCE AND CONTROLLED BY SURFACE TENSION EFFECTS

(71) Applicant: David V. Schiavi, Logan Township, NJ (US)

(72) Inventor: David V. Schiavi, Logan Township, NJ (US)

( * ) Notice: Subject to any disclaimer, the term of this patent is extended or adjusted under 35 U.S.C. 154(b) by 252 days.

(21) Appl. No.: 15/622,120

(22) Filed: Jun. 14, 2017

(65) Prior Publication Data

US 2017/0363281 A1 Dec. 21, 2017

Related U.S. Application Data

(60) Provisional application No. 62/350,380, filed on Jun. 15, 2016.

(51) Int. Cl.

| | |
|---|---|
| ***F21V 35/00*** | (2006.01) |
| ***F21V 1/10*** | (2006.01) |
| ***F23D 3/16*** | (2006.01) |
| *F21V 3/00* | (2015.01) |
| *F21V 37/00* | (2006.01) |

(52) U.S. Cl.

CPC ..... *F21V 35/00* (2013.01); *F21V 1/10* (2013.01); *F23D 3/16* (2013.01); *F21V 3/00* (2013.01); *F21V 37/0058* (2013.01); *F21V 37/0066* (2013.01); *F23D 2700/003* (2013.01)

(58) Field of Classification Search

CPC .. F21V 35/00; F21V 37/0066; F21V 37/0058; F21V 1/10; F21V 3/00; F23D 3/16; F23D 2700/003

USPC ..... 431/289, 291, 312; 362/163, 161, 186

See application file for complete search history.

(56) References Cited

U.S. PATENT DOCUMENTS 589,173 A * 8/1897 Henke ..... F21V 35/00 40/441
3,686,494 A * 8/1972 Naylor ..... F21S 10/06 40/441
3,701,897 A * 10/1972 Pennington ..... F21V 5/06 362/278

(Continued)

FOREIGN PATENT DOCUMENTS

DE 3431018 A1 * 3/1986 ..... F21S 13/12
GB 2272968 A * 6/1994 ..... F21L 19/00

*Primary Examiner* — Steven B McAllister
*Assistant Examiner* — Daniel E. Namay
(74) *Attorney, Agent, or Firm* — Devlin Law Firm LLC; James M. Lennon

(57) ABSTRACT

A device comprising a floating body/s that creates a meniscus that is either concave or convex in a liquid surface along a perimeter of the floating body/s, and a blade/s that are connected to the floating body/s which can change the direction of a flow of fluid, where there is another meniscus on the liquid surface that is curved in an opposing direction of the first meniscus so the second meniscus is able to repel the floating object from the first meniscus. If the first meniscus created by the floating body/s is convex, then the opposing meniscus on the liquid surface is concave, or if the first meniscus is concave, then the opposing meniscus is convex. Thus, embodiments can create various movements when fluid flow interacts with the blade/s, yet be repelled from areas on the liquid surface. Other embodiments are described and shown.

17 Claims, 61 Drawing Sheets

(56) References Cited

U.S. PATENT DOCUMENTS

| | | | | |
|---|---|---|---|---|
| 4,185,953 | A * | 1/1980 | Schirneker | C11C 5/006 362/163 |
| 4,827,382 | A * | 5/1989 | Feliks | F21V 1/10 362/294 |
| 5,491,616 | A * | 2/1996 | Reed | F21V 1/10 362/35 |
| 5,683,239 | A * | 11/1997 | Cardosi | F21V 35/00 362/163 |
| 6,631,999 | B1 * | 10/2003 | Chang | F21V 1/10 362/101 |
| 7,168,948 | B2 * | 1/2007 | Swearingen | A47G 33/06 362/161 |
| 7,214,054 | B2 | 5/2007 | Boulachanis | |
| 2002/0105808 | A1 * | 8/2002 | Ting Yup | F21S 10/02 362/281 |
| 2003/0016523 | A1 * | 1/2003 | Pickens | F21V 1/10 362/35 |
| 2003/0232299 | A1 * | 12/2003 | Chang | F21V 1/10 431/253 |
| 2004/0086815 | A1 * | 5/2004 | Hermanson | A61L 9/03 431/126 |
| 2004/0265760 | A1 * | 12/2004 | Swearingen | A47G 33/06 431/125 |
| 2004/0265763 | A1 | 12/2004 | Boulachanis | |
| 2013/0157208 | A1 | 6/2013 | Kazadi | |

* cited by examiner

SYSTEM FOR CREATING MOVEMENT USING A HEAT SOURCE AND CONTROLLED BY SURFACE TENSION EFFECTS

This application claims priority to U.S. Provisional Patent Application No. 62/350,380, filed on Jun. 15, 2016, the disclosure of which is incorporated by reference herein in its entirety.

TECHNICAL FIELD

The present invention relates to movement devices and more particularly to movement devices driven by a heat source such as but not limited to a lit candle, wherein the movement of the device is controlled by surface tension effects.

BACKGROUND ART

The following is a tabulation of some prior art that presently appears relevant:

| U.S. patents | | | |
|---|---|---|---|
| U.S. Pat. No. | Kind Code | Issue Date | Patentee |
| 7,168,948 | B2 | 2007 Jan. 30 | Swearingen |
| 7,214,054 | B2 | 2007 May 8 | Boulachanis |
| **U.S. Patent Application Publications** | | | |
| Publication Number | Kind Code | Publ. Date | Patentee |
| 20130157208 | A1 | 2013 Jun. 20 | Kazadi |
| 20040265763 | A1 | 2004 Dec. 30 | Boulachanis |
| **Foreign Patent Documents** | | | |
| Pat. No. | Kind Code | Issue Date | Patentee |
| CN 203757676 | U | 2014 Aug. 6 | 王伟强 |
| CN203177136 | U | 2013 Sep. 4 | 施申饶 |
| CN203757677 | U | 2014 Aug. 6 | 干伟强 |

NONPATENT LITERATURE DOCUMENTS

National Candle Association "Facts & Figures about candles" http://candles.org/facts-figures-2/Copyright 2016

"Pyramids from the German Christmas shop: History" http://www.thegermanchristmasshop.com/christmaspyramid/history.htm "The history of floating water lanterns" https://www.birando.com/history-of-floating-water-lanterns There are various methods of transferring the energy of a difference in temperature into mechanical motion. One of the earliest methods was a wind turbine. The sun heats the surface of the earth creating a temperature difference, which creates a difference in air pressure driving flow in the form of wind.

There are also numerous ways to create light which also tends to produce heat. One of the earliest ways to provide light is from a wicked device such as a candle. Wicked devices such as candles continue to be used even though there are more efficient and practical methods. The National Candle Association claims "the sales of candles are estimated at approximately $2 billion annually, excluding the sales of candle accessories" and the reason for this is "nine out of ten candle users say they use candles to make a room feel comfortable or cozy." Because the candle is so inefficient at transferring chemical energy into light, most of the excess energy is transferred to heat. The flame of the candle is surrounded by air, which when heated, expands locally because of the temperature gradient. The expansion of the air lowers its density relative to the surrounding air and creates a buoyancy driven flow of air through the candle. This buoyancy driven flow is possible in all fluids whose thermal expansion coefficient is non-zero and is exposed to a large enough temperature gradient to overcome viscous forces. Some people were able to take advantage of this wasted heat from candle light and transfer it into mechanical motion by the use of a turbine to create a visually pleasing effect. It is thought that people had developed models of turning pyramids driven by rising heat in the Erzgebirge Mountains of Germany in the early 1800s. These devices have to be made very precisely to allow it to spin. The rotor has to be very low friction, and the rotational inertia of the device has to be low enough that it is able to spin from the flow of hot air.

There are many examples of people using the buoyancy driven flow of air to create visually pleasing items. Some of these items are mentioned in U.S. Pat. No. 7,168,948, Chinese Patents No. 203,757,676; 203,177,136, and 203,757,677, but these must have a shaft with an apex in a spindle that is received within a fan hub to for a friction rotation point or axle mechanism for the fan.

The idea of floating lanterns has been around for hundreds of years in Asia.

Recently people have ignored the use of thermal energy available in the candles and use items such as electric motors and to drive the movement of candles floating on platforms such as Nick Boulachanis in his U.S. Pat. No. 7,214,054 in 2007 to create pleasant visual effects.

People have tried to combine several of these concepts into something in the form of an animated floating candle that is driven by heat generated by the light such as Sanza Nkashama Tshilobo Kazadi in U.S. Patent Publication No. US20130157208. This device uses the heat generated by candle light to move a float which holds two candles along a virtual axle created by magnets located on the float and on the container below. The magnets however are a large hindrance in the design of a device because of several reasons. Firstly, the magnets are expensive. Secondly, the magnets are heavy. The added weight on the float from the magnet must be overcome by the buoyant force of the float. To increase the buoyancy force, the float needs to be made larger than what would otherwise be required. The magnets do create a virtual axis when placed near each other, but they also unfortunately attract one another exerting an additional force that the buoyancy force has to overcome. This means, that the float must be made even larger, to overcome this attraction of the magnets. The magnets must be sized in such a way that they do not create a float that is too large, and they attract each other enough to prevent the float from brushing up on the side of the container restricting its motion. These limitations are very inconvenient when dealing with the very small force generated by heat of the candle. A larger float creates more resistance when turning because of larger area that is shearing the liquid; also, a larger float may have more inertia and rotational inertia. These resistances require a higher energy output of the heat source to turn or into motion. In the case of a candle, this means a higher burn rate or more candles. A higher burn rate means the candle will burn for a shorter amount of time unless it is made larger, which would add more weight for the float to overcome. A larger device is harder to transport in between uses, takes up more storage space, an is typically more expensive because more materials are used. Also, as the candles burn, the buoyancy of the float will increase. This may separate the two magnets enough that they do not retain a virtual axle.

SUMMARY OF THE EMBODIMENTS

A first embodiment includes a device that comprises a floating body or floating bodies that create a meniscus that is either concave or convex in a liquid along a perimeter of the floating body or floating bodies, and a structure in the form of a blade or blades that are connected to said floating body or floating bodies which are located above a heat source so that they change the direction of a buoyancy driven flow of fluid (which can include air) from said heat source, where there is another adjacent meniscus on the liquid surface that has an opposing curvature of the concave or convex meniscus that is able to repel the floating object from the location of the other meniscus on the liquid. For example, if the meniscus created by the floating body is convex, then the other opposing meniscus on the liquid surface is concave, or the other case being if the meniscus created by the floating body is concave, then the other opposing meniscus on the liquid is convex.

Accordingly, several advantages of one or more aspects are as follows: to provide movement of a blade/s or a floating body/s, to provide this pleasing effect at low expense, to provide this effect with minimal energy input, to provide this effect with small size, to prevent a moving floating body which has a meniscus that is either concave or convex from being attracted in a horizontal direction to another meniscus on the liquid surface due to a capillary force (otherwise known as the cheerio effect), to repel itself from walls of a container, to repel itself to other objects in contact with the surface of the liquid, to allow motion without the use of electric motors, to allow motion without magnets, that does not require a large float because of added weight of a magnet, that does not require a large float to overcome a magnetic force, that does not require a faster burn rate of a heat source because of a larger float, that does not require as large a heat source because of a larger float, that is easier to transport because of its smaller size, that is easier to store because of its smaller size, that does not require rotational shaft, and that does not require a joint for a rotor that creates friction between two solid objects. It is worth noting the capillary forces of the cheerio effect causes a problem when trying to create motion driven by a heat source on a liquid surface by attracting the floating object to another object, container, or edge of the liquid, which creates much more resistance for the device to overcome, where the presented machine uses the same physical phenomenon as an advantage to prevent contact of the floating object to another object or edge of the liquid. For example, the floating object can be made to repel itself from the walls of a container, thereby creating a virtual axle in which to rotate without the use of magnets or other objects to hold it in place. Other advantages of one or aspects will be apparent from a consideration of the drawings and ensuing description.

BRIEF DESCRIPTION OF THE DRAWINGS—FIGURES

In the drawings, closely related figures have the same number but different alphabetic suffixes.

FIGS. 1 and 2 illustrate a floating candle with blades constructed in accordance with one embodiment; FIG. 1 is a perspective view and FIG. 2 is a cross-section view of the same.

FIG. 3, a perspective view, illustrates tea light with blades constructed in accordance with another embodiment.

FIG. 4, a perspective view, illustrates a floating wick constructed in accordance with another embodiment.

FIG. 5, a perspective view, illustrates a floating oil lamp constructed in accordance with another embodiment.

FIG. 6, a cross-sectional view, illustrates a modified floating tea light constructed in accordance with an embodiment floating in a cup of liquid where the liquid meniscus touching the modified floating tea light is concave along its perimeter and the liquid meniscus touching the container walls is convex.

FIG. 7, a cross-sectional view, illustrates a modified floating tea light constructed in accordance with an embodiment floating in a cup of liquid where the liquid meniscus touching the modified floating tea light is convex along its perimeter and the liquid meniscus touching the container walls is concave.

FIG. 8, a cross-sectional view, illustrates a modified tea light constructed in accordance with an embodiment floating in a cup of liquid where the liquid creates a concave meniscus along the perimeter of the modified tea light and the liquid is filled to the brim of the cup which creates a convex liquid meniscus along the brim.

FIG. 9, a cross-sectional view, illustrates a modified tea light constructed in accordance with an embodiment floating in a cup of liquid where the liquid creates a concave meniscus along the perimeter of the modified tea light and the liquid is filled a level in the cup where the angle of surface of the cup creates a convex liquid meniscus.

FIG. 10, a cross-sectional view, illustrates a modified tea light constructed in accordance with an embodiment floating in a cup of liquid where the liquid creates a concave meniscus along the perimeter of the modified tea light and the liquid is filled a level in the cup where the angle of surface of the cup creates a convex liquid meniscus and the diameter of the cup is made to be large compared to the size of the modified tea light so that the surface of the water does not change drastically when the cup changes buoyancy while burning fuel.

FIG. 11, a cross-sectional view, shows a lit modified floating wick constructed in accordance with the embodiment floating in a container of liquid fuel where the liquid creates a convex meniscus along the perimeter of the floating wick and a concave meniscus along the wall of the container.

FIG. 12, a cross-sectional view, illustrates a floating oil lamp constructed in accordance with an embodiment, in a container of liquid, where the floating oil lamp creates a concave meniscus along its perimeter, and the liquid creates a concave meniscus along the container and where the floating oil lamp is surrounded by a spacer ring also in the same liquid that creates a convex meniscus along its perimeter.

Figure 15:
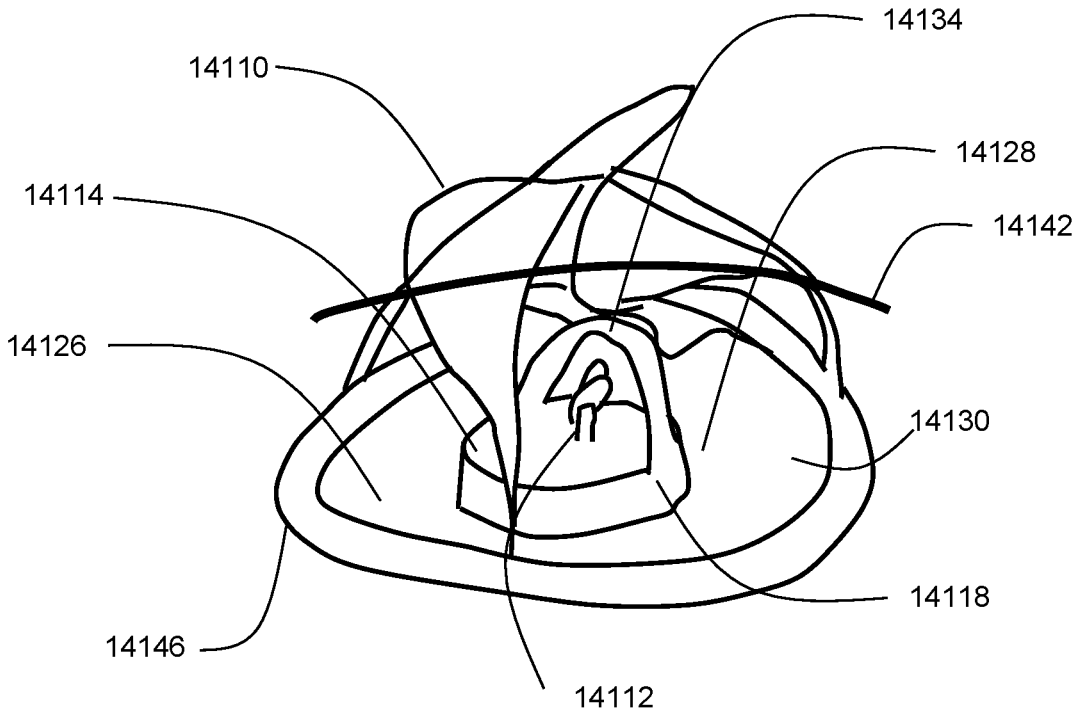

FIG. 15, a perspective view, illustrates a modified floating tea light constructed in accordance with an embodiment floating in a container of liquid and a spacer ring with blades constructed in accordance with another embodiment floating in the same container where both the spacer ring and the floating candle is able to rotate from the heat of the tea light and be repelled from the walls of the container and each other because of proper curvature of the liquid surface between objects.

Figure 16:
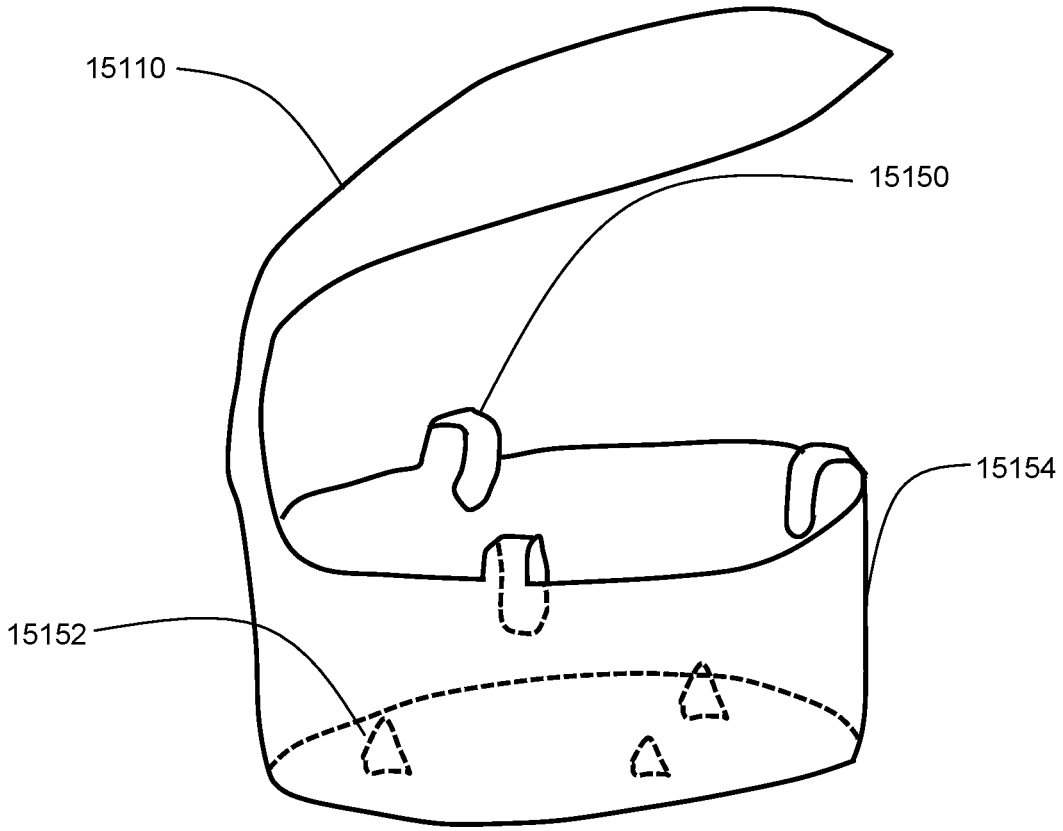

FIG. 16, a perspective view, illustrates a tea light holder with a blade and supports to reduce contact surface area of the tea light to the holder constructed in accordance with another embodiment.

Figure 17:
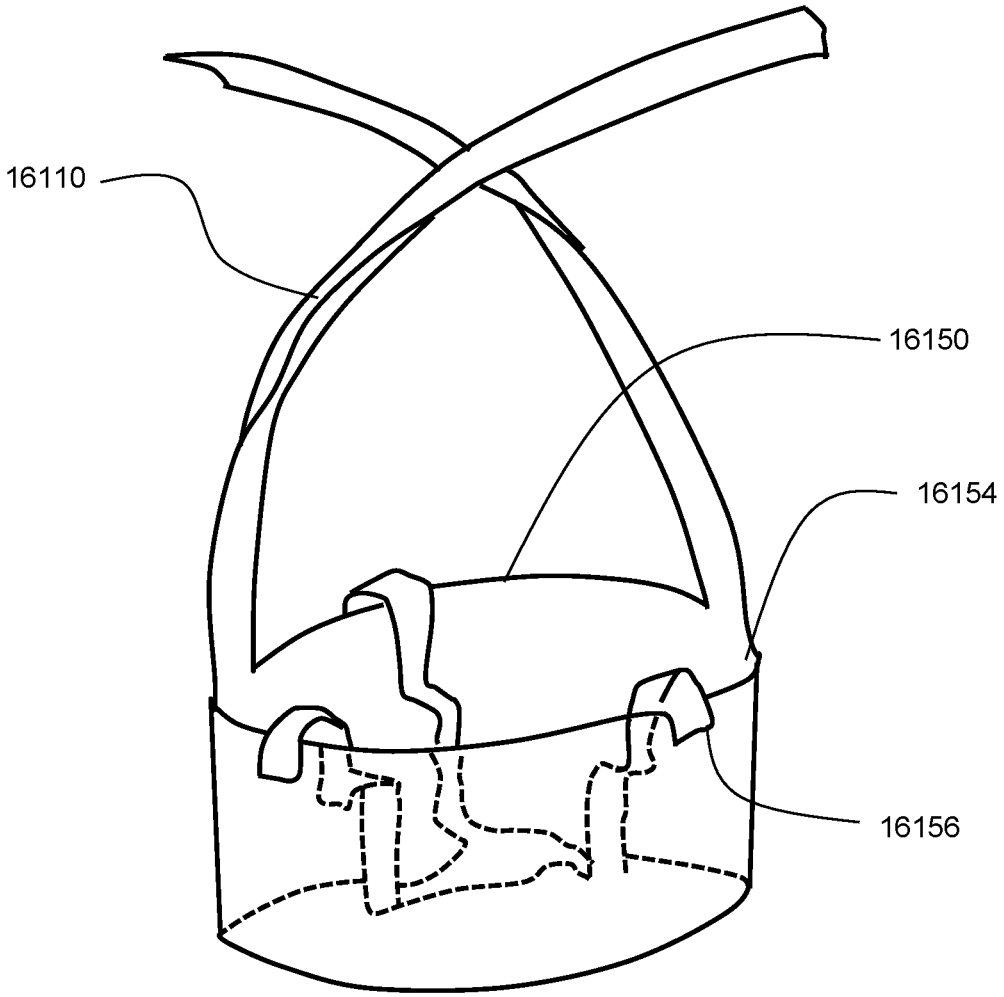

FIG. 17 shows a similar tea light holder with two blades constructed in accordance with another embodiment and a support hanger for the tea light to prevent the tea light from directly contacting the surface of the holder.

Figure 18:
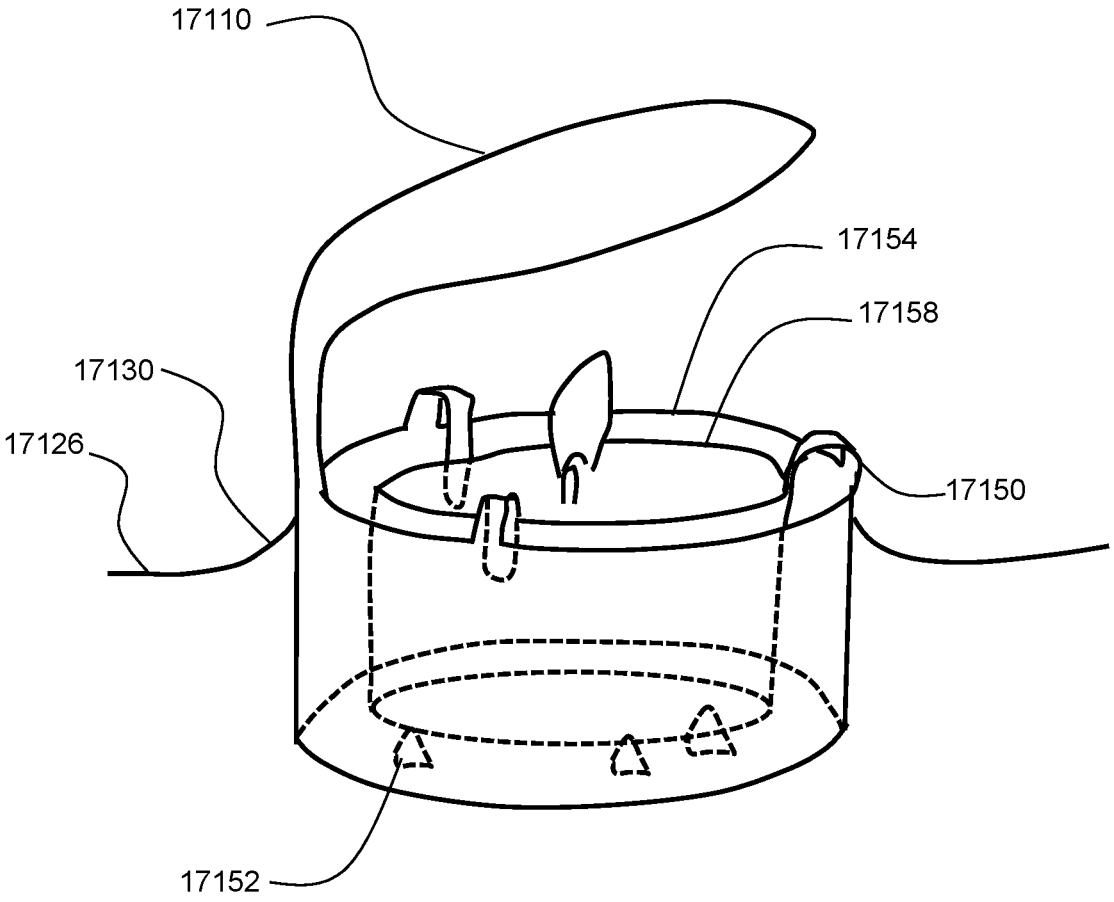

FIG. 18, a perspective view, shows the same embodiment of FIG. 15 with a tea light inserted and a liquid surface that is concave along the perimeter of the floating body.

Figure 19:
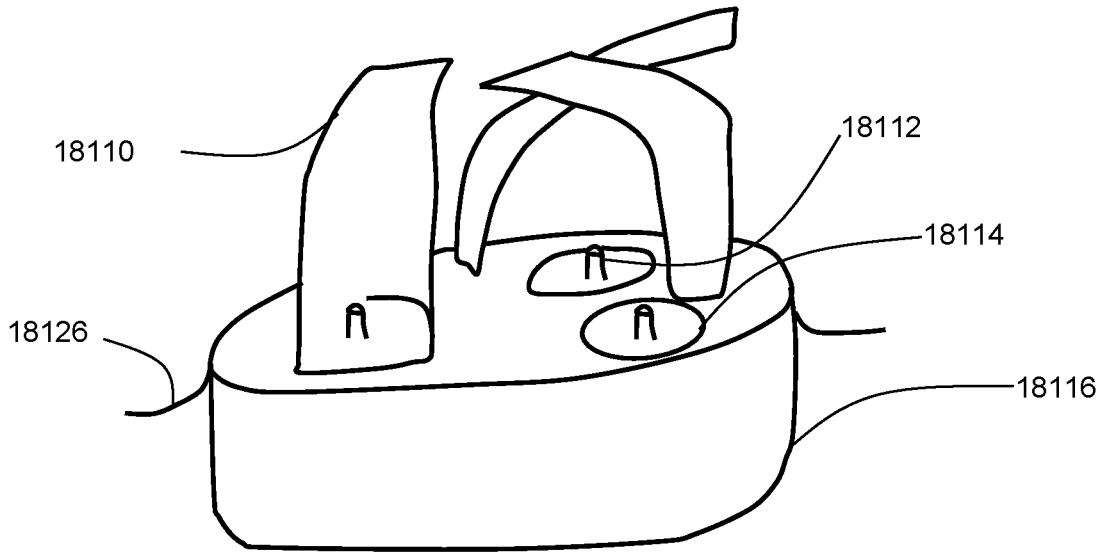

FIG. 19, a perspective view, illustrates a floating candle with multiple wicks and blades constructed in accordance with another embodiment.

Figure 20:
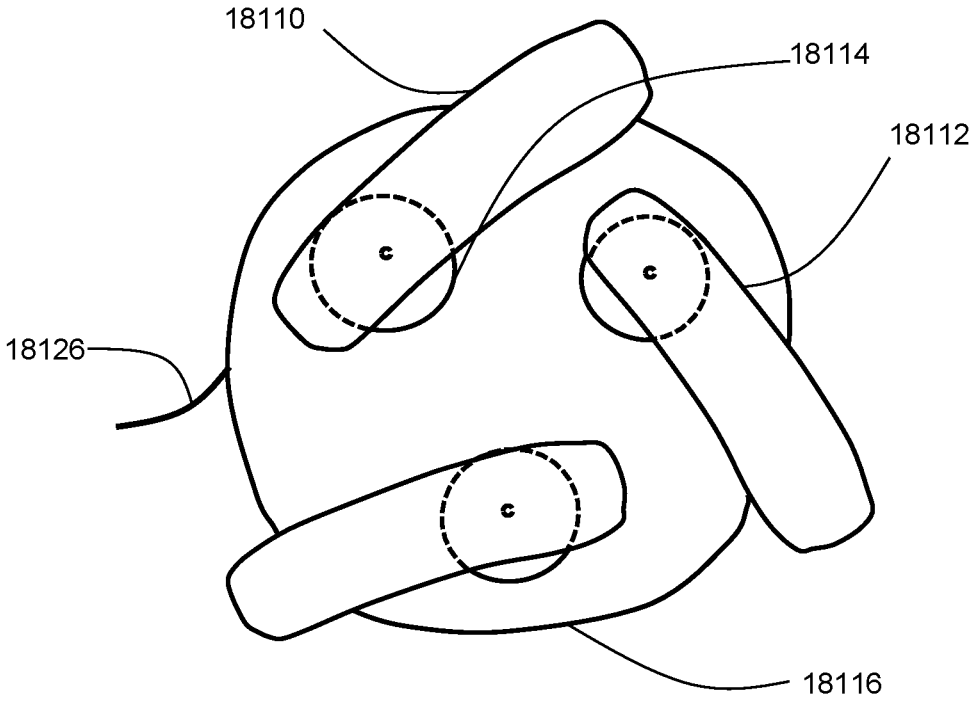

FIG. 20, a view from the top, shows the same floating candle with multiple wicks and blades where the blades reach overtop of the wicks.

Figure 21:
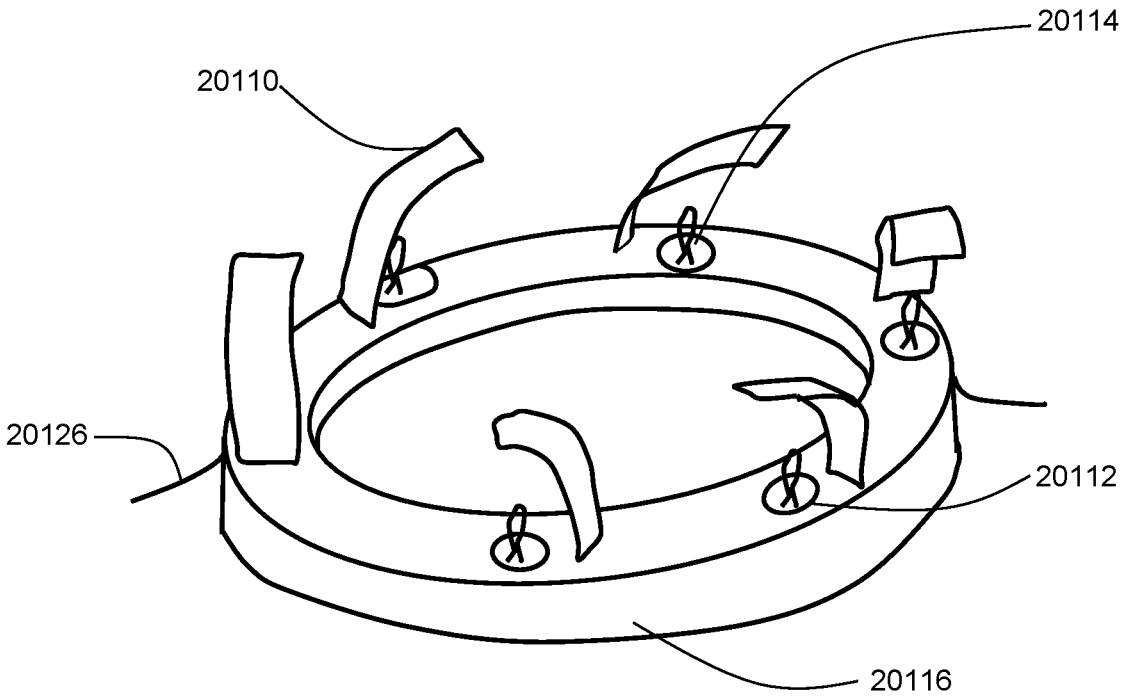

FIG. 21, a perspective view, illustrates a floating candle with multiple wicks and blades in the general shape of a torus constructed in accordance with another embodiment.

Figure 22:
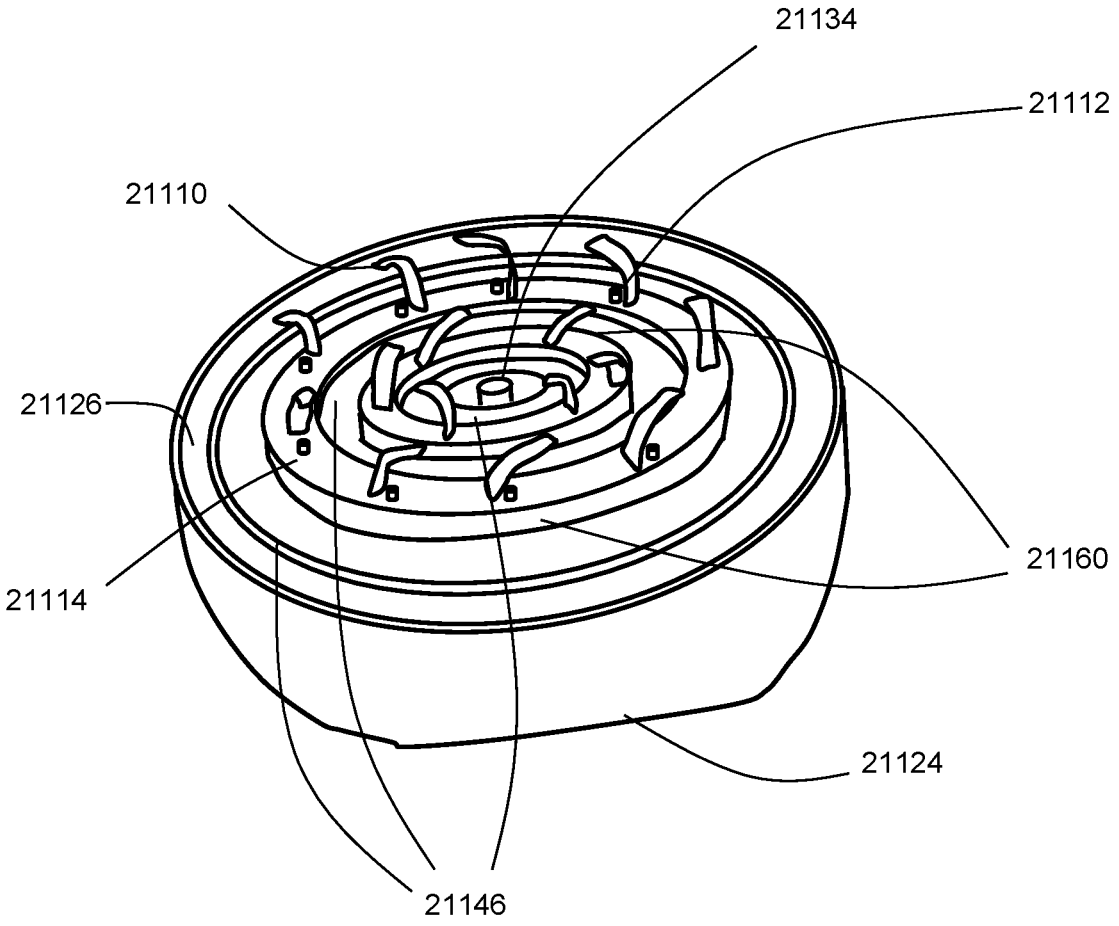

FIG. 22, a perspective view, illustrates a modified tea light constructed in accordance with an embodiment in a container of liquid inside of a spacer ring which is surrounded by a floating candle with multiple wicks and blades in the general shape of a torus constructed in accordance with the another embodiment which is surrounded by another larger spacer ring which is surrounded by another larger floating candle with multiple wicks and blades in the general shape of a torus constructed in accordance with the another embodiment which is surrounded by yet another even larger spacer, which is finally surrounded by the container wall.

Figure 23:
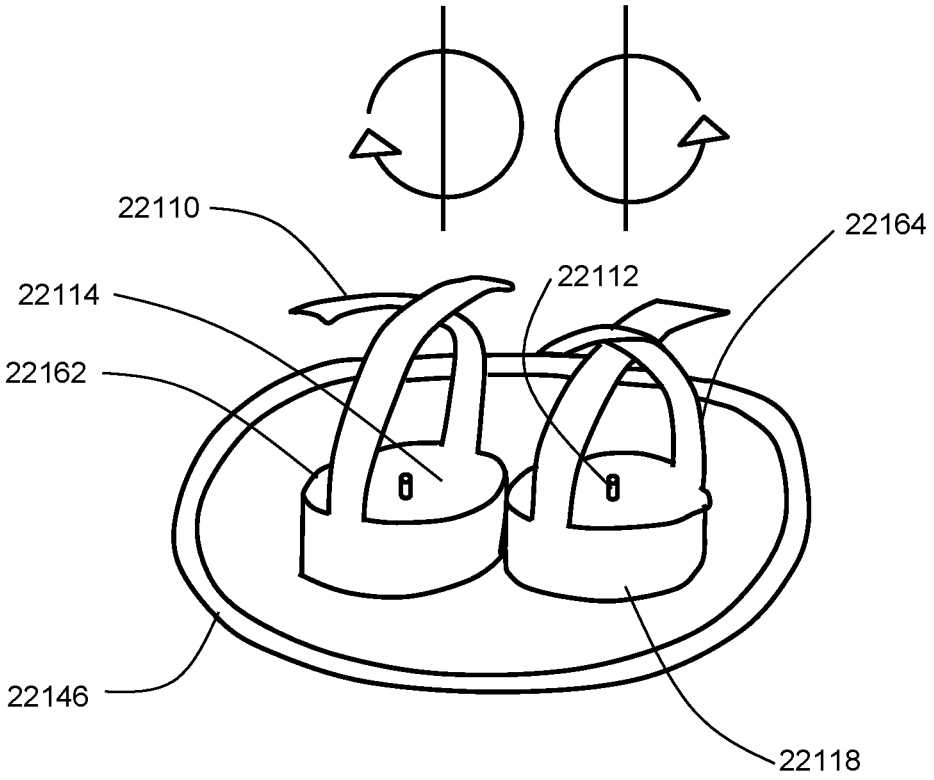

FIG. 23, a perspective view, shows a clockwise spinning modified tea light constructed in accordance with an embodiment next to and attracted by a capillary force to a counterclockwise spinning modified tea light constructed in accordance with an embodiment where both of the modified tea lights are surrounded by a spacer ring in a pool of liquid.

Figure 24:
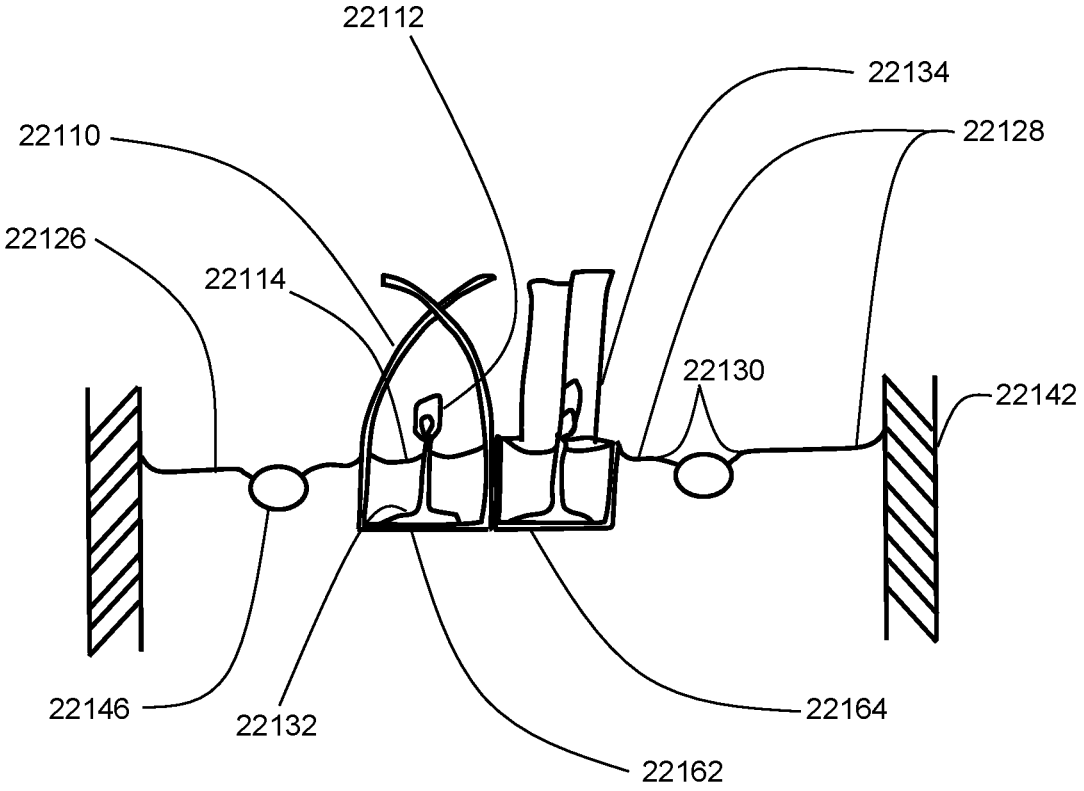

FIG. 24 shows a similar arrangement in a cross-sectional view where it is easily seen that the meniscus of the liquid is concave surrounding the perimeter of the two modified tea lights constructed in accordance with an embodiment, concave against the wall of the container, and convex against spacer.

Figure 25:
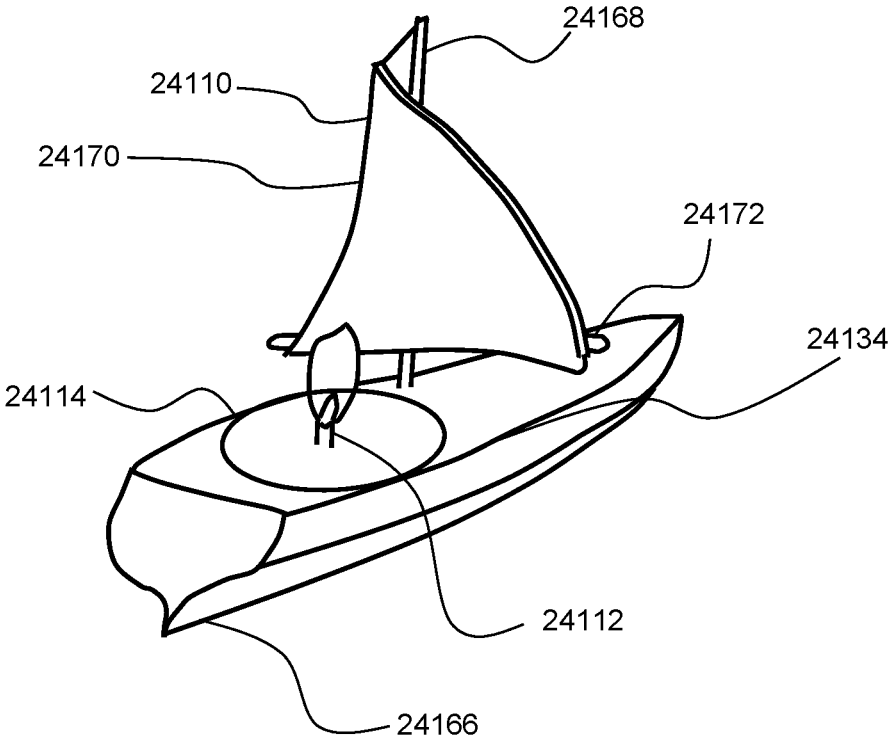

FIG. 25, a perspective view, shows a wicked device in the shape of a sailboat that is constructed in accordance with another embodiment.

Figure 26:
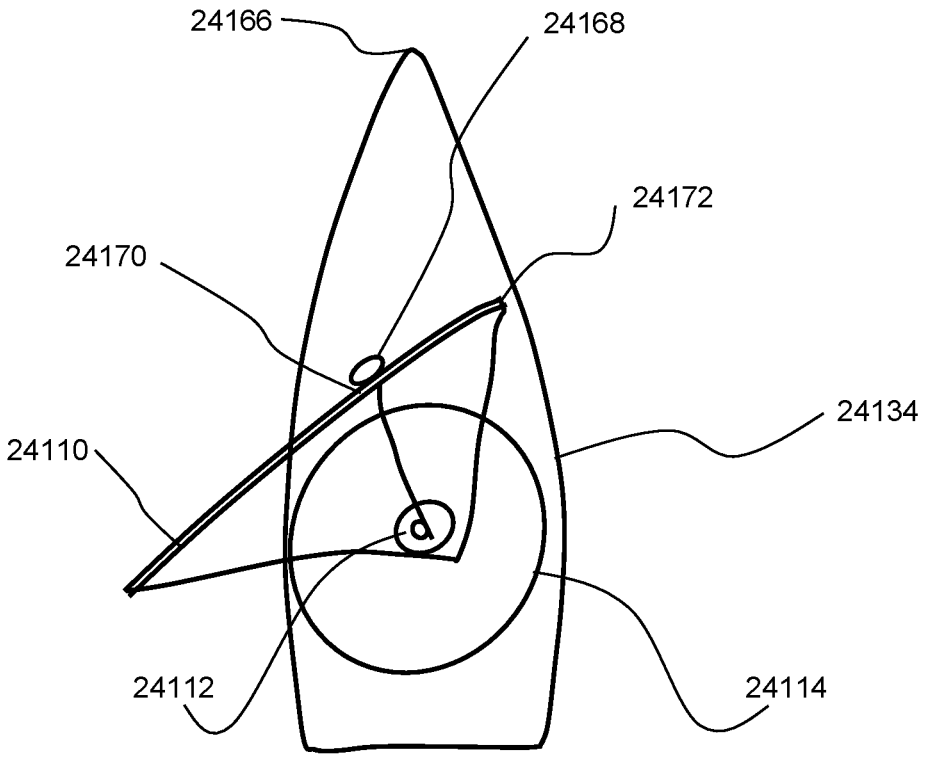

FIG. 26, a view from the top, shows a similar wicked device in the shape of a sailboat where it can be seen how the sail is made to be bent horizontally so that the buoyant air stream that will result from the burning wick changes direction.

Figure 27:
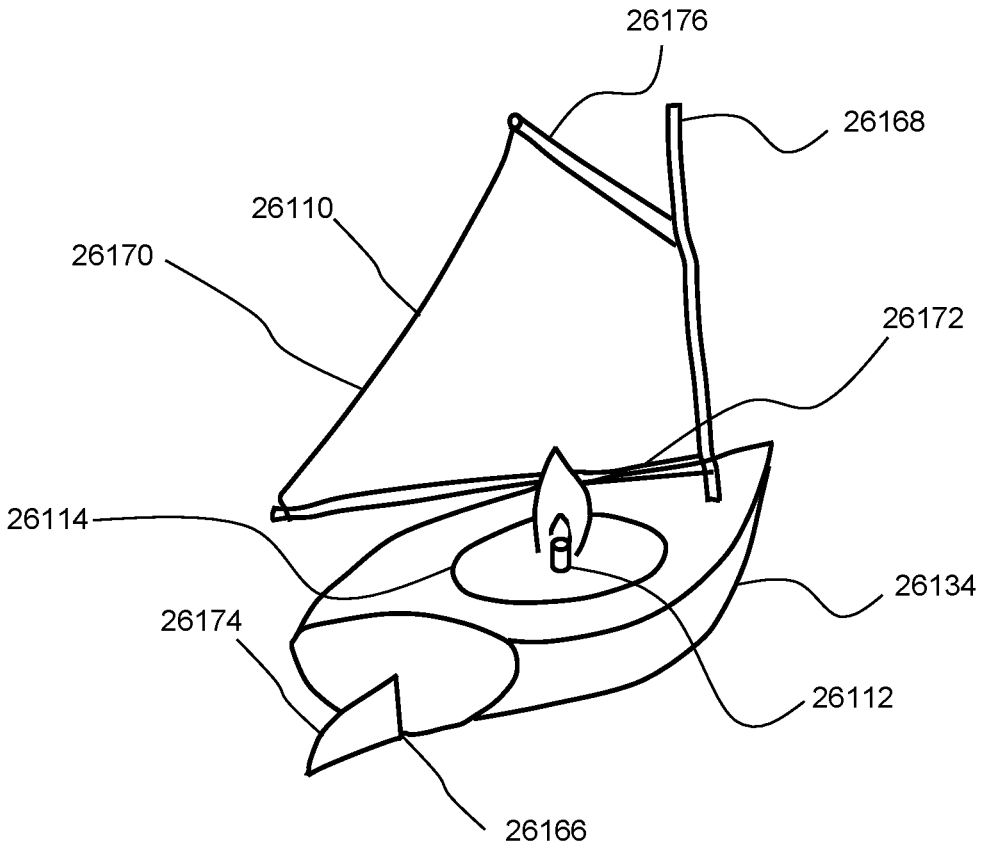

FIG. 27, a perspective view, shows a wicked device in the shape of a catboat that is constructed in accordance with another embodiment.

Figure 28:
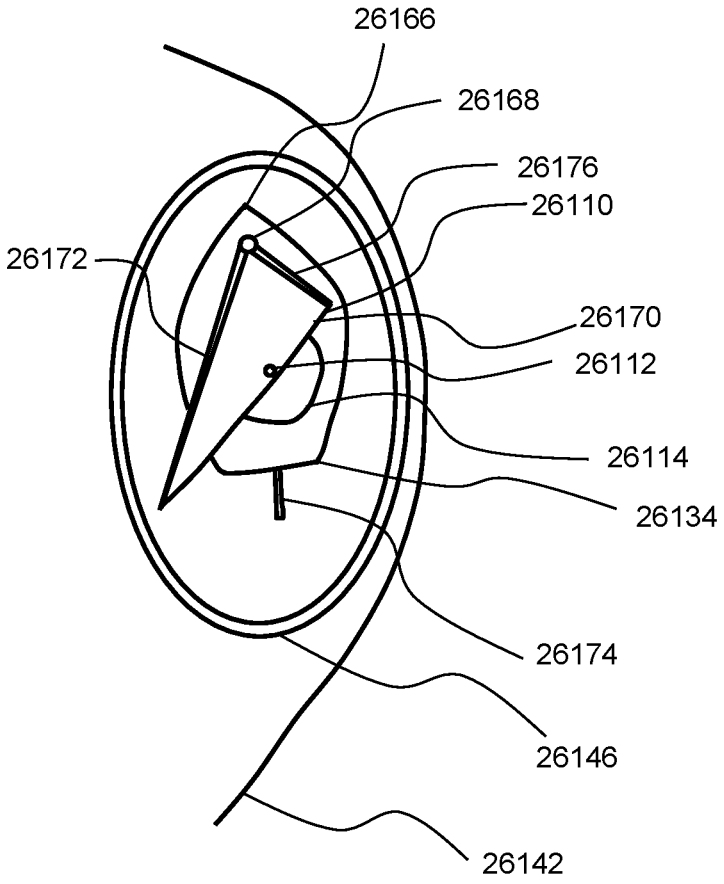

FIG. 28, a view from the top, shows a similar wicked device in the shape of a catboat where it can be seen how the sail is made to be bent horizontally so that the buoyant air stream that will result from the burning wick changes direction and is surrounded by a spacer that helps the catboat from becoming attached to the container wall and travel freely.

Figure 29:
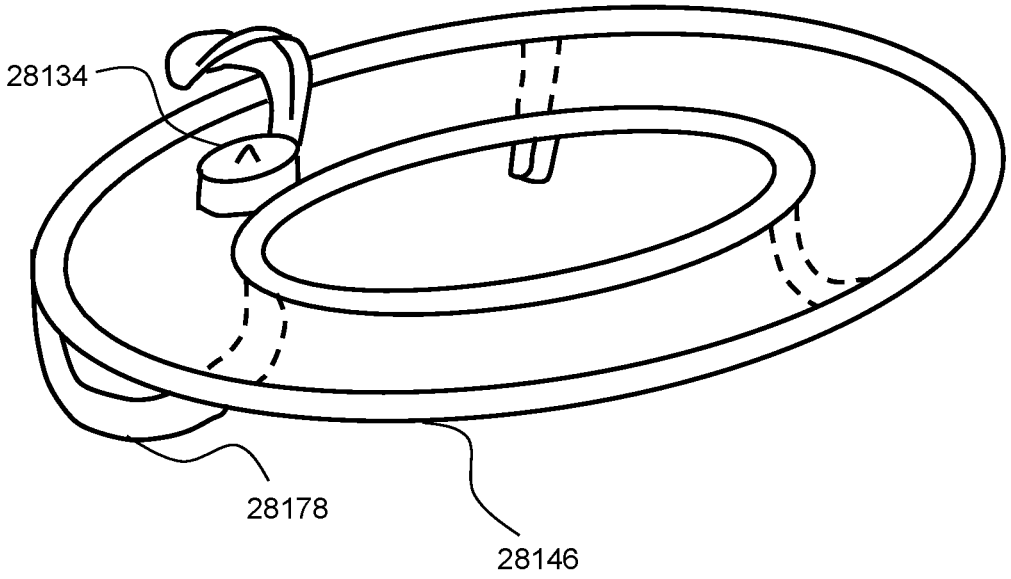

FIG. 29, a perspective view, illustrates a modified tea light with a blade constructed in accordance with an embodiment where it is able to travel along a path created by two spacer rings held in place with connecting pieces.

Figure 30:
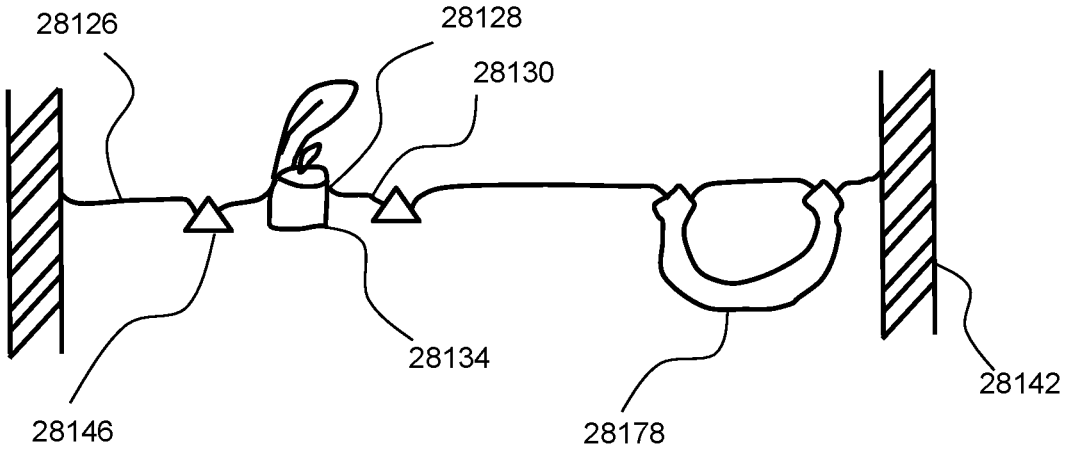

FIG. 30, a cross-sectional view from the side, shows a similar arrangement where it can easily be seen that the spacer rings create a path for the modified tea light to travel because it is repelled by the spacers and the spacers can be also repelled by the walls of the container and that the connecting piece between the two spacer rings does not interfere with the traveling modified tea light.

Figure 31:
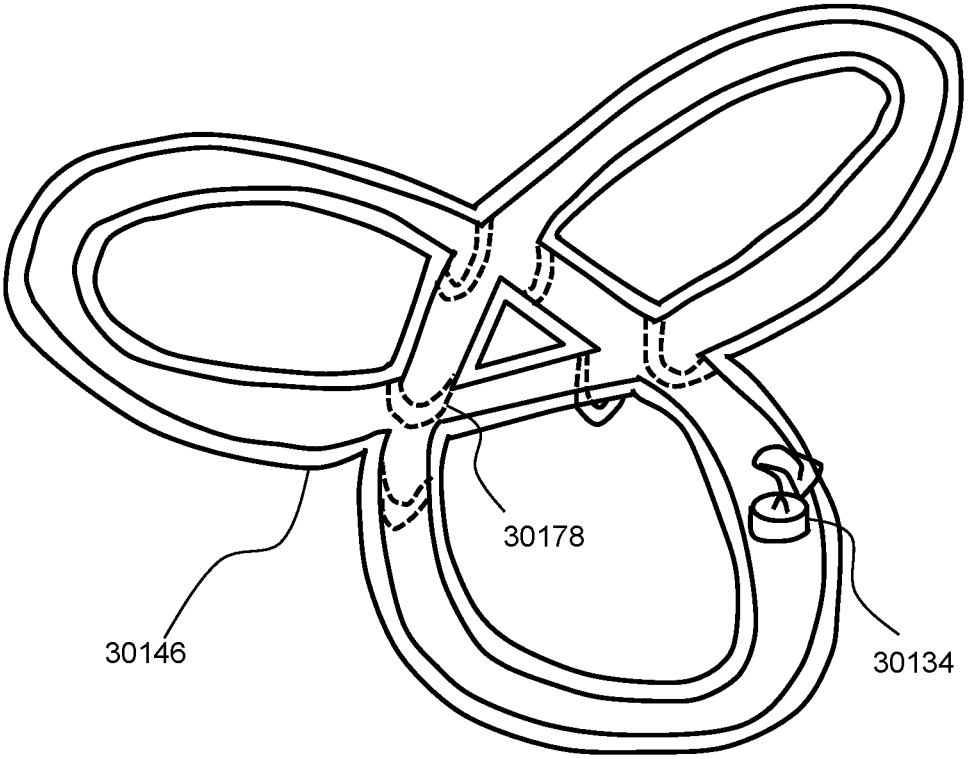

FIG. 31, a perspective view, illustrates a modified tea light constructed in accordance with an embodiment that travels along a more complex path but using the same elements.

Figure 32:
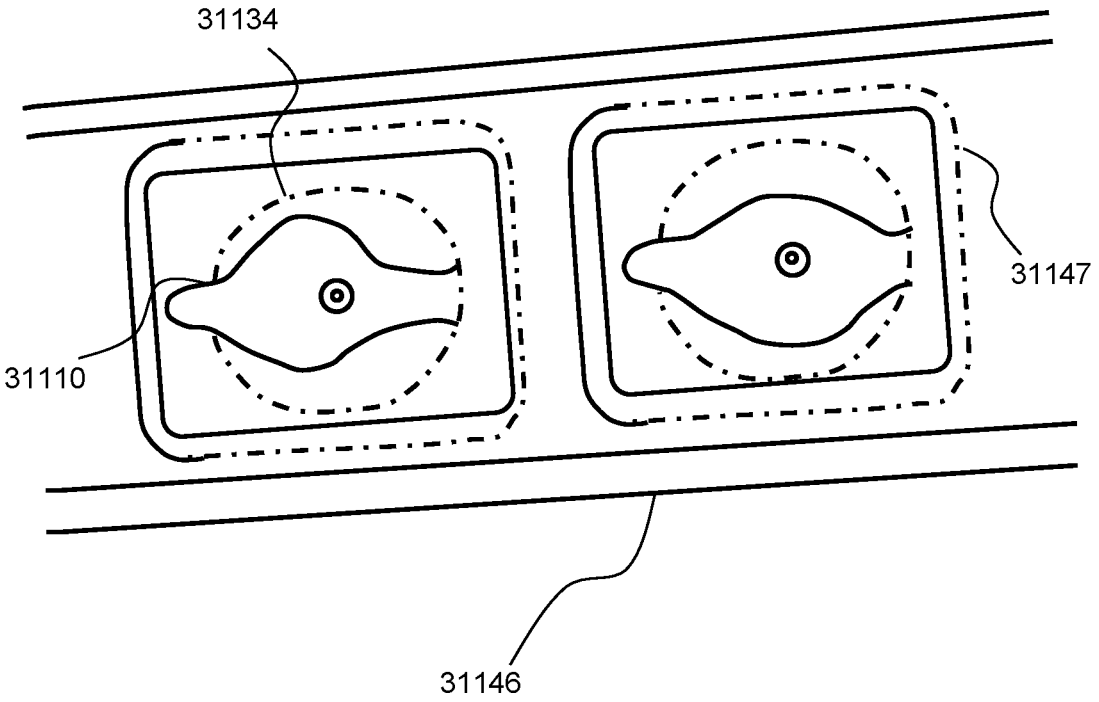

FIG. 32, a view from the top, illustrates a modified self-propelled wick holding device with a blade constructed in accordance with an embodiment that creates a concave meniscus around its perimeter and is surrounded by a rectangular shaped spacer.

Figure 33:
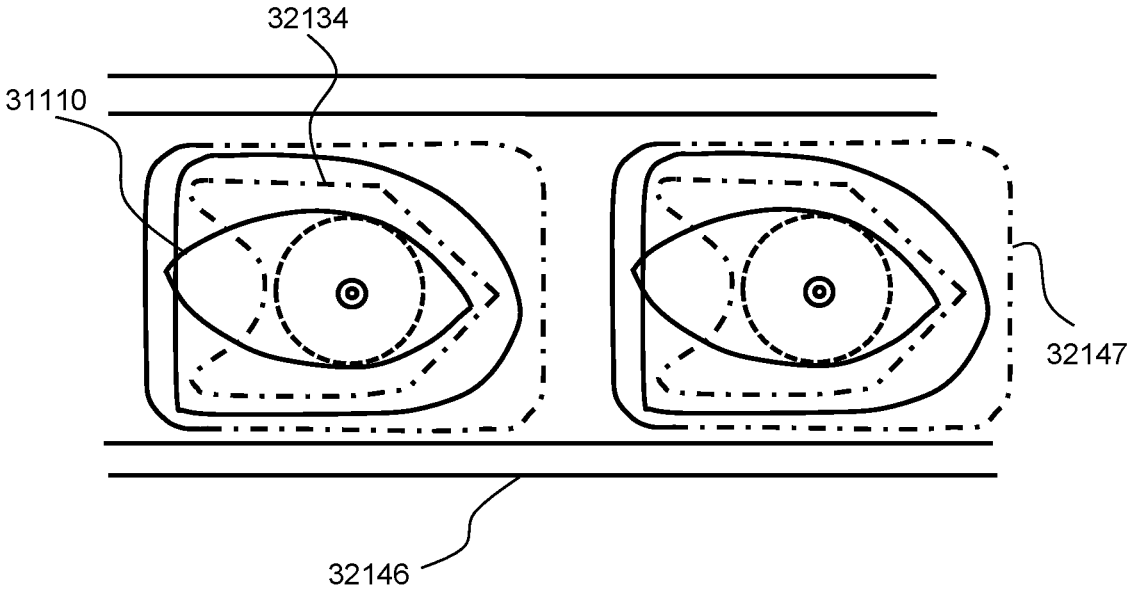

FIG. 33, a view from the top, shows a similar arrangement now with the modified self-propelled wick holding device surrounded by a spacer where both are shaped in such a way that makes it difficult for the self-propelled wick holding device to rotate 180 degrees from its original direction on the path.

Figure 34:
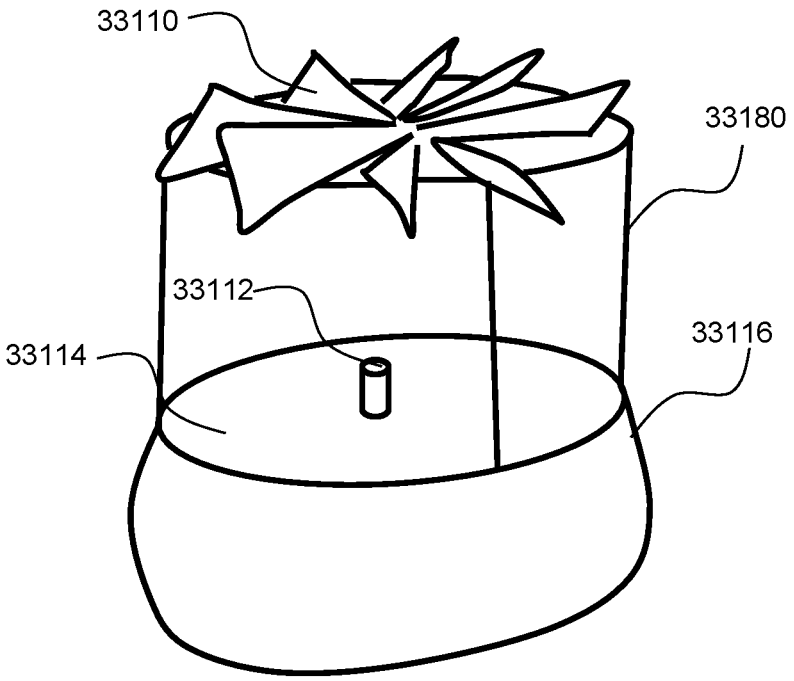

FIG. 34, a perspective view, illustrates a floating candle with a topper made with blades in the shape of a fan made in accordance with another embodiment that also shows the blades connected to supports that can be made so that there is no frictional joint or movement of the rotor relative to the support structure.

Figure 35:
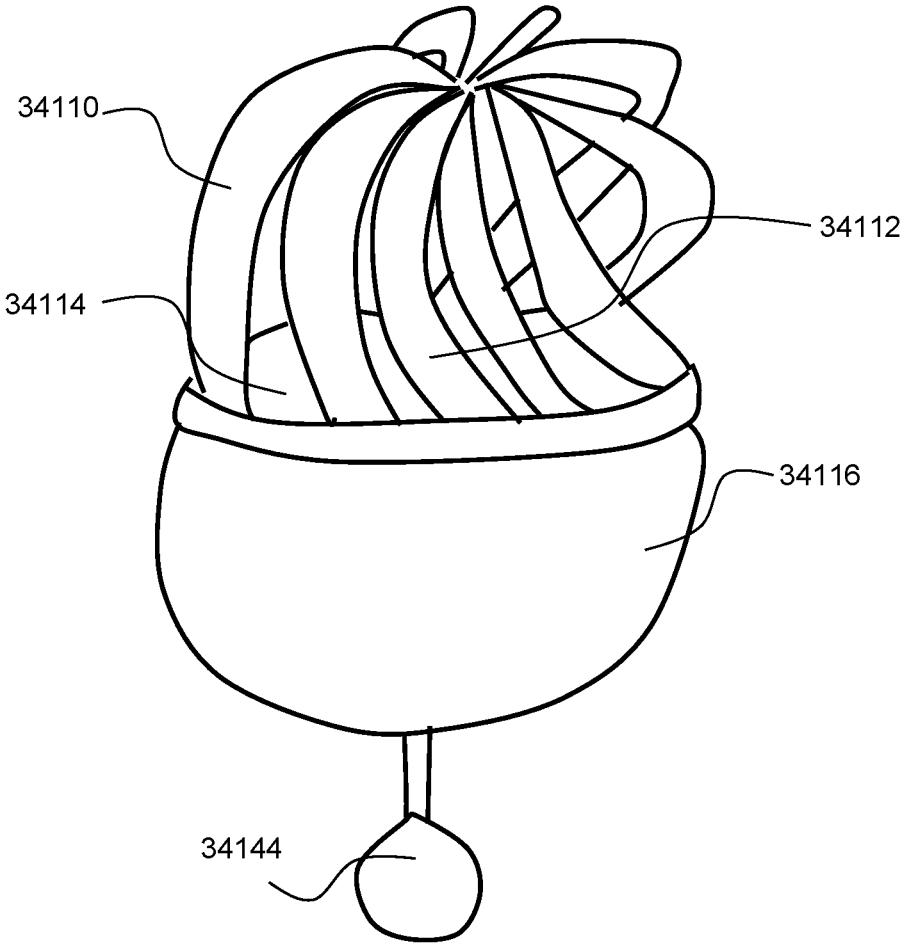

FIG. 35, a perspective view, illustrates a floating candle with a topper made with blades in the shape similar to a roof air vent (otherwise known as a "whirlybird") constructed in accordance with the invention which can have a counterweight attached to a lower portion of the device to keep the float in a stable orientation by lowering its center of gravity relative to its center of buoyancy.

Figure 36:
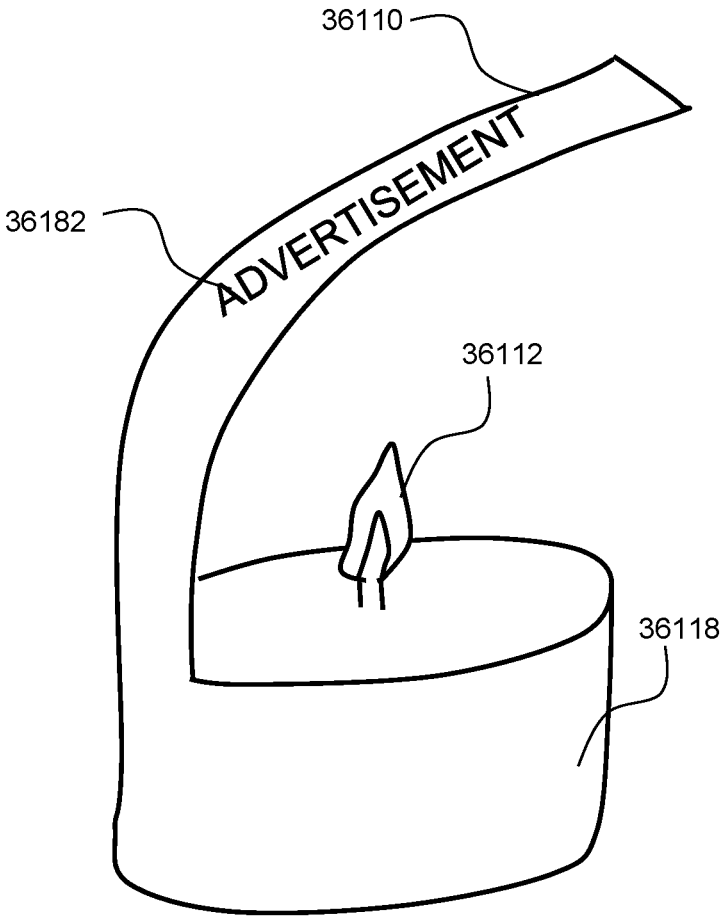

FIG. 36, a perspective view, illustrates a modified tea light with a blade constructed in accordance with another embodiment that displays an advertisement on the blade which can be created by various materials which have different optical properties from the rest of the blade or are cut out of the blade so that the light is able to pass through the blade illuminating the advertisement.

Figure 39:
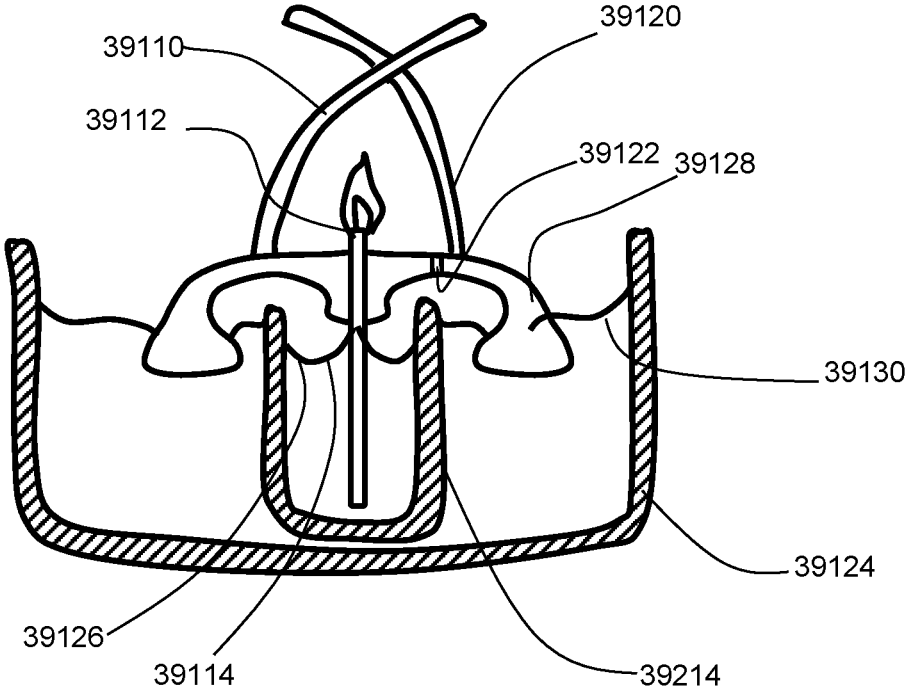

FIG. 39, a perspective view, illustrates a modified tea light with a blade constructed in accordance with another embodiment that is floating in a container of liquid which creates a concave meniscus along the perimeter of the modified tea light and a concave meniscus along the inside wall of the container and where the modified tea light is surrounded by a spacer that creates a convex meniscus on the liquid surface displays and advertisement in a similar way where the advisement or shadow of the advertisement is projected onto a surface whereby the projected image travels along the projection surface in the direction of rotation of the modified tea light.

Figure 38:
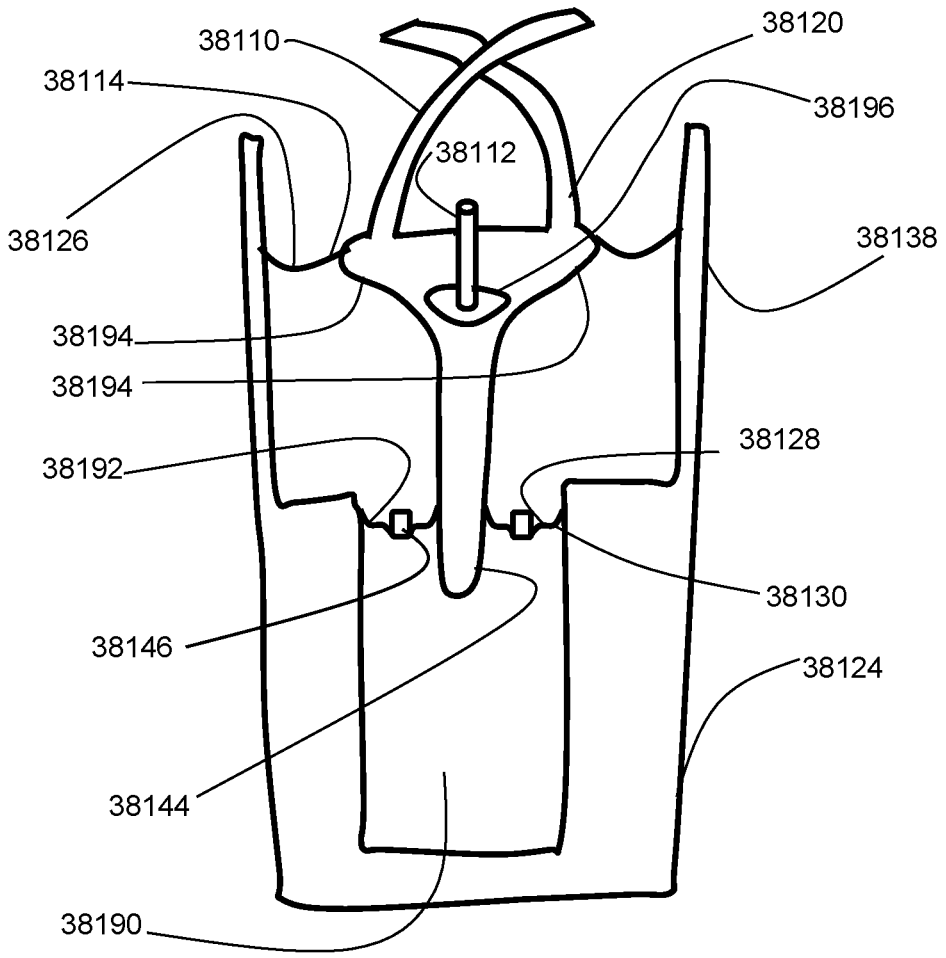

FIG. 38, a cross-sectional view from the side, illustrates a modified floating wick with blades device constructed in accordance with another embodiment which is sitting in a container with two immiscible liquids of different densities where the top liquid can act as a fuel for the modified floating wick and the denser fluid can cause the light to extinguish when the modified floating wick lowers to a certain level as the fuel is being spent where the modified floating wick can have features that aid in stability such as an extended rim and a counter weight that also can extend below the interface of the two immiscible liquids which can create a concave meniscus of the denser liquid along the container at the liquid-liquid interface and the modified floating wick body at the liquid-liquid interface that is surrounded by a spacer ring whose bulk density is in a range where it is able to stabilize on the liquid interface and create an convex meniscus of the denser liquid on the inside and outside perimeter of the spacer along the liquid-liquid interface whereby the modified floating wick is stable pushed towards the center of the container because it is repelled by the forces of the liquid-liquid interface which are stronger that the attractive capillary forces on interface of the less denser liquid and the surrounding air.

FIG. 39, a cross-sectional view from the side, illustrates a modified floating wick with blades constructed in accordance with another embodiment which creates a convex meniscus along a perimeter of the modified floating wick which can have a vent to prevent a vacuum from being created when the fuel is being spent and which is floating in a container of liquid where the liquid creates a concave meniscus along the wall of the container and there is another smaller container within the first container that contains fuel that is separated from the wick holding device but is still accessible by the wick.

Figure 40:
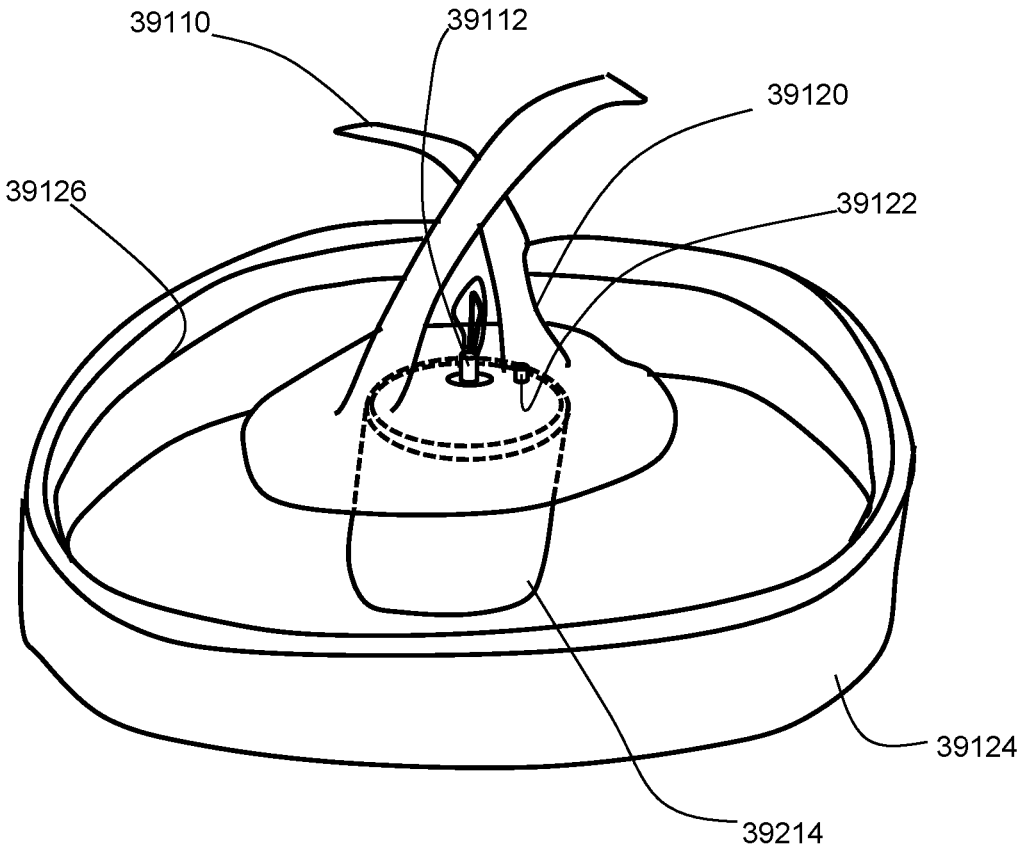

FIG. 40 shows a similar arrangement in a perspective view.

Figure 41:
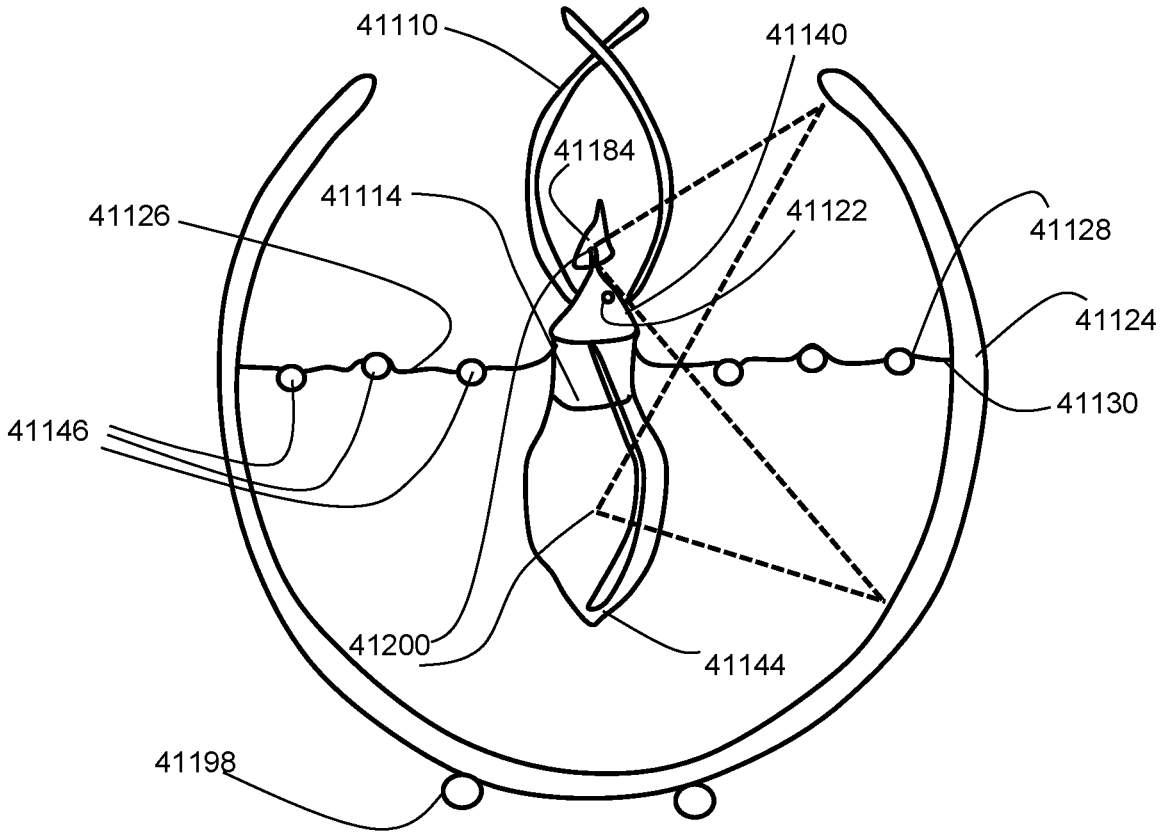

FIG. 41, a cross-sectional view from the side, illustrates a modified oil lamp with blades constructed in accordance with another embodiment which is surrounded by several spacer rings in a container of liquid in the general shape of a prolate spheroid with an opening at the top liquid where the container is capable of reflecting some light from the lamp internal to the container and back on to the lamp.

Figure 42:
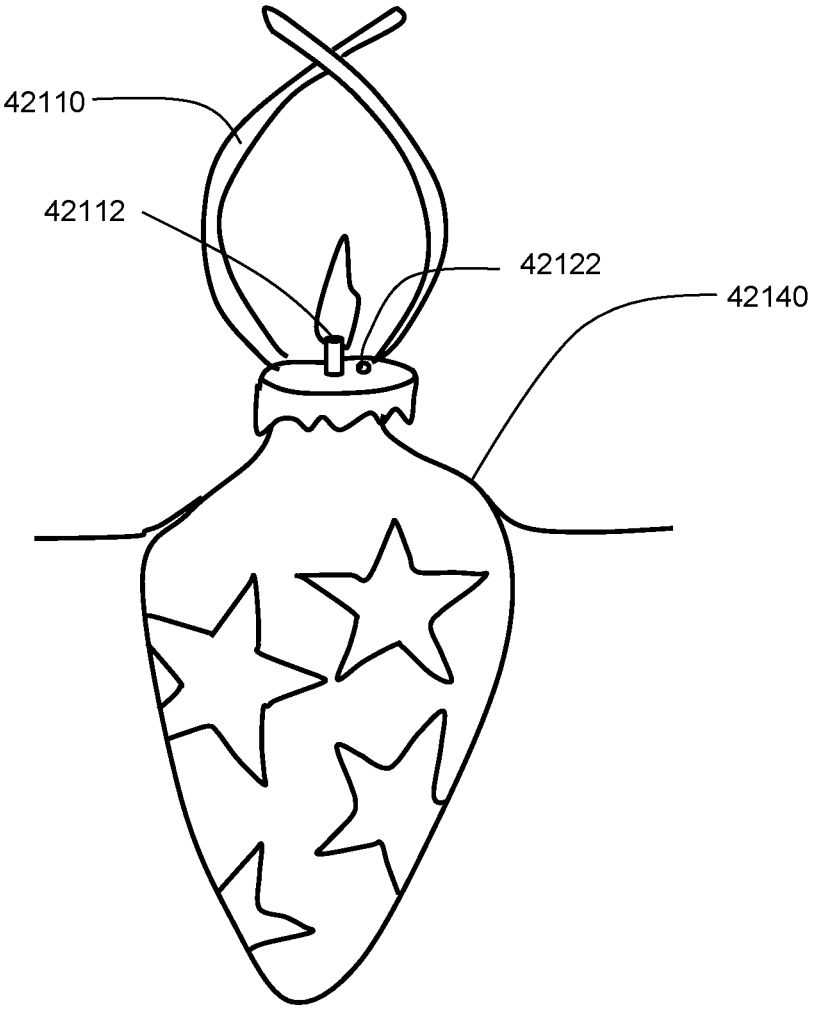

FIG. 42, a view from the side, illustrates a modified floating oil lamp with blades constructed in accordance with another embodiment which has decorations on the surface of the floating oil lamp body.

Figure 43:
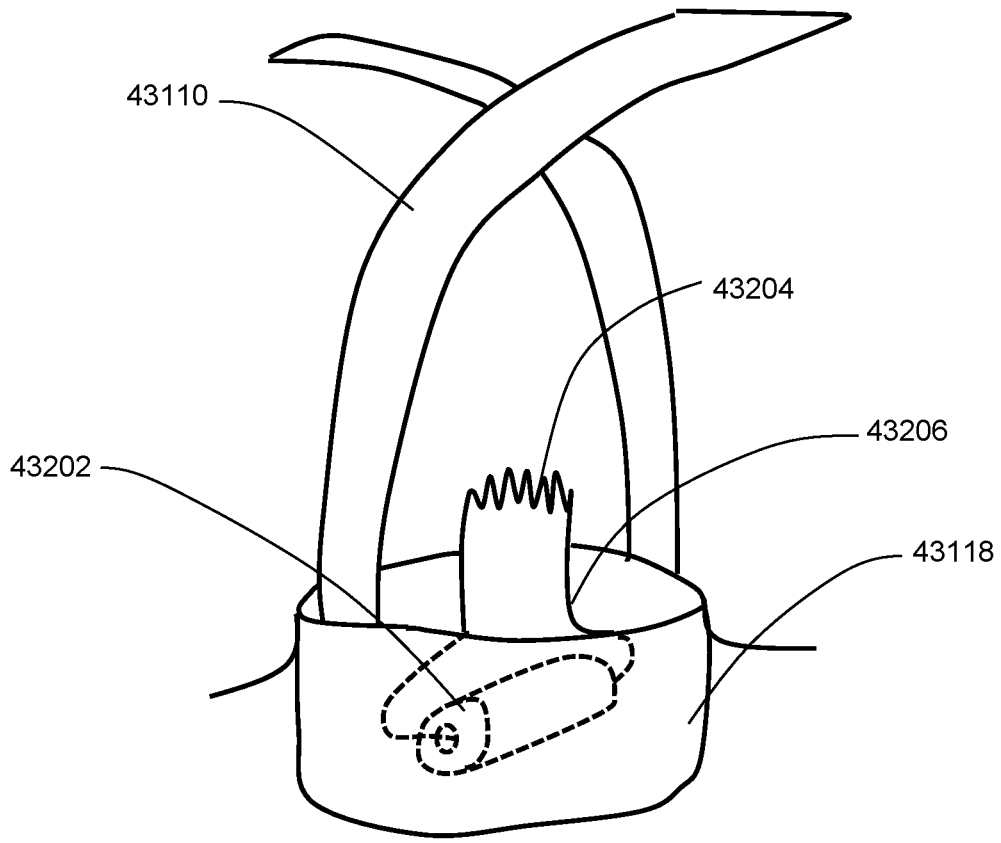

FIG. 43, a perspective view, illustrates a floating device with blades constructed in accordance with another embodiment that uses a resistor in place of a wick for positioning and creating a source of heat that can propel the floating device, where the resistor is powered by a power source which can be a battery inside the device.

Figure 44:
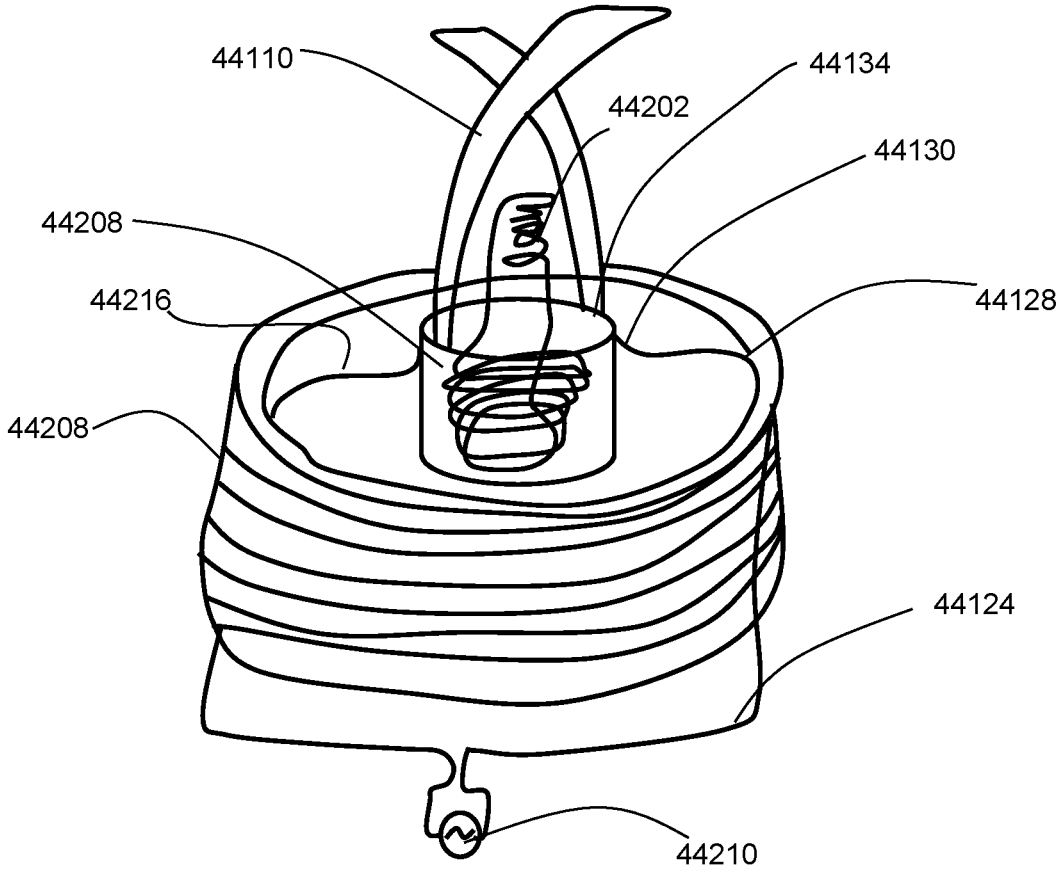

FIG. 44, a perspective view, illustrates a floating device with blades constructed in accordance with another embodiment that uses a resistor in place of a wick for positioning and creating a source of heat that can propel the floating device, where the resistor is powered by an inductor located within the floating device which is powered by the magnetic field of another inductor which is powered by an alternating current power source.

Figure 45:
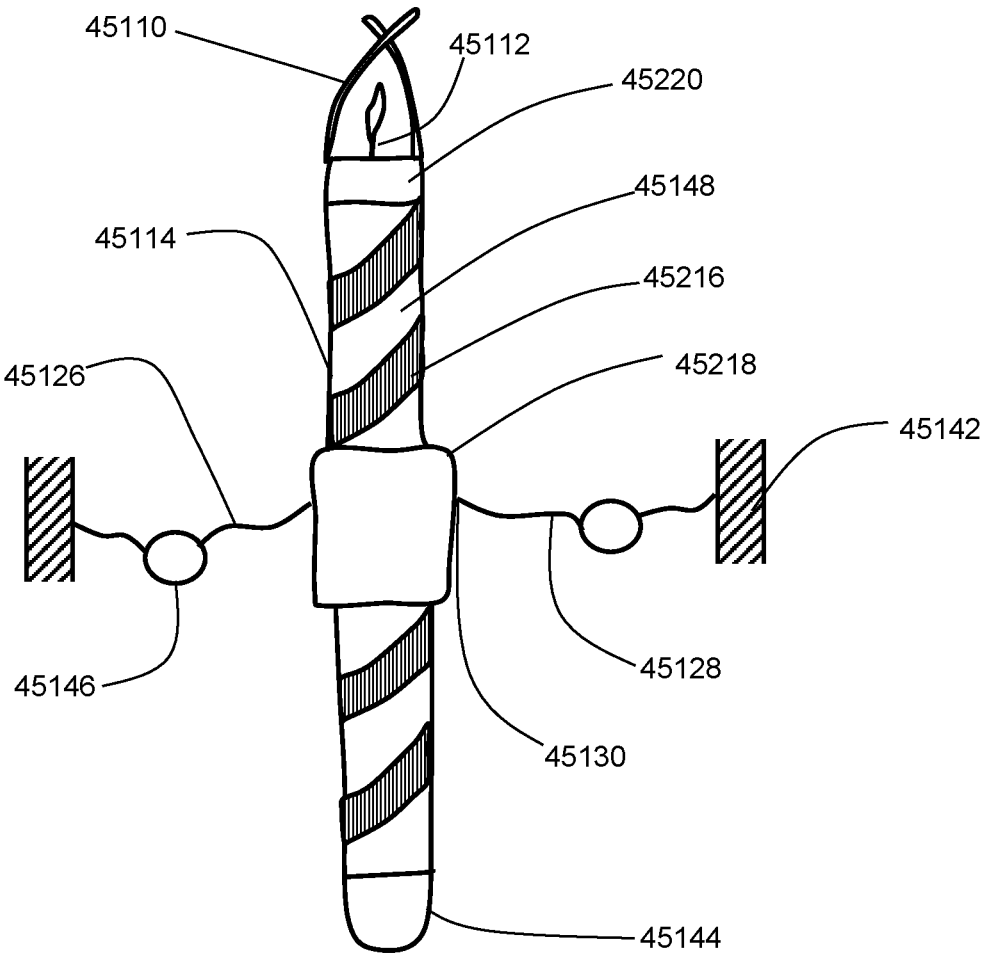

FIG. 45 illustrates an embodiment in a cross-sectional view from the side of a self-propelled floating candle device 45148 similar to other embodiments of the same type.

Figure 46:
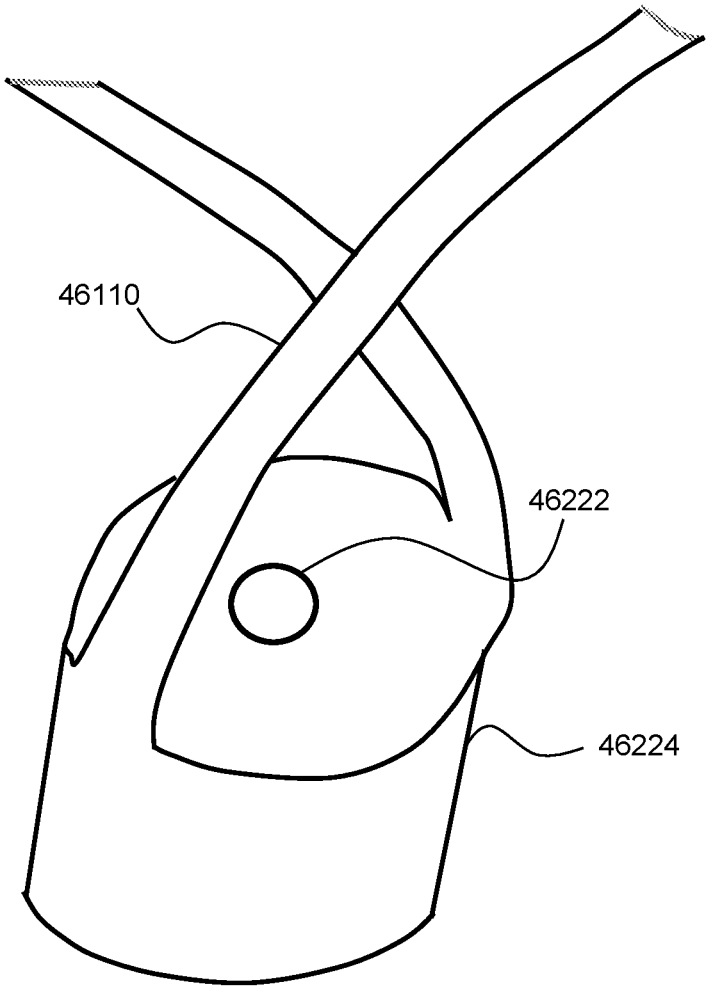

FIG. 46 illustrates in a perspective view an embodiment of a modified candle follower with blades 46110 similar to that shown in FIG. 45.

Figure 47:
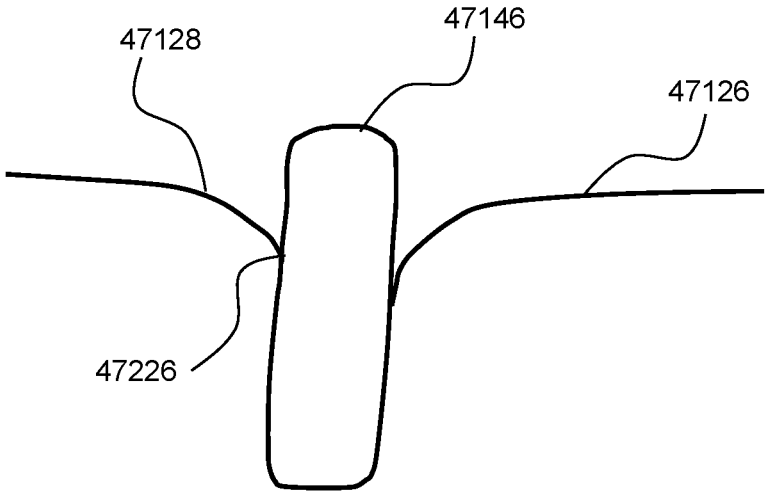

FIG. 47 shows a cross-sectional view from the side of a spacer similar to the spacer with a circular cross-section as shown in other embodiments which can be part of a ring torus shaped.

Figure 48:
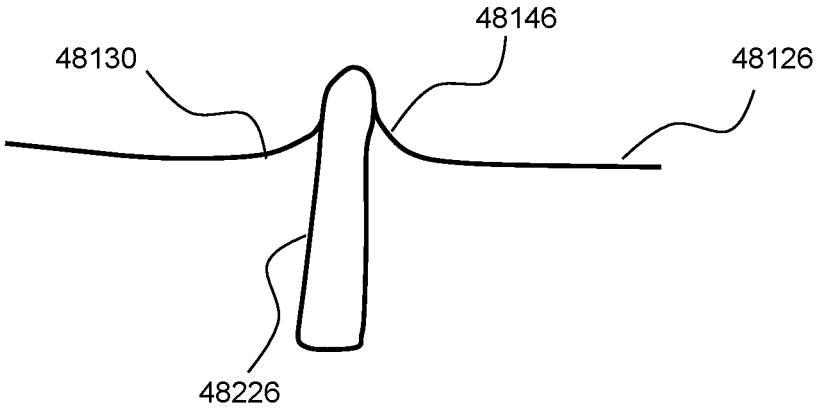

FIG. 48 shows a similar spacer 48146 creating a concave meniscus 48130 on the liquid surface 48126 with a similarly vertical surface 48226.

Figure 49:
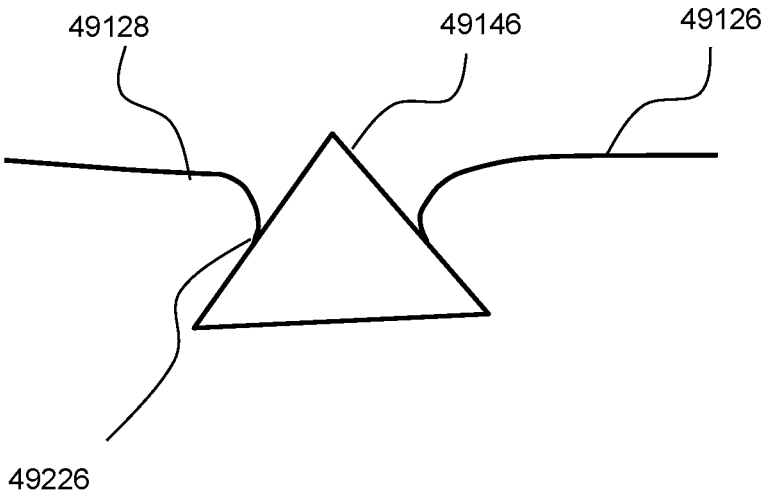

FIG. 49 shows a spacer 49146 similar to that of FIG. 47 except that it has much a much less steep angled surface 49226 on each side forming the general shape of a triangle.

Figure 50:
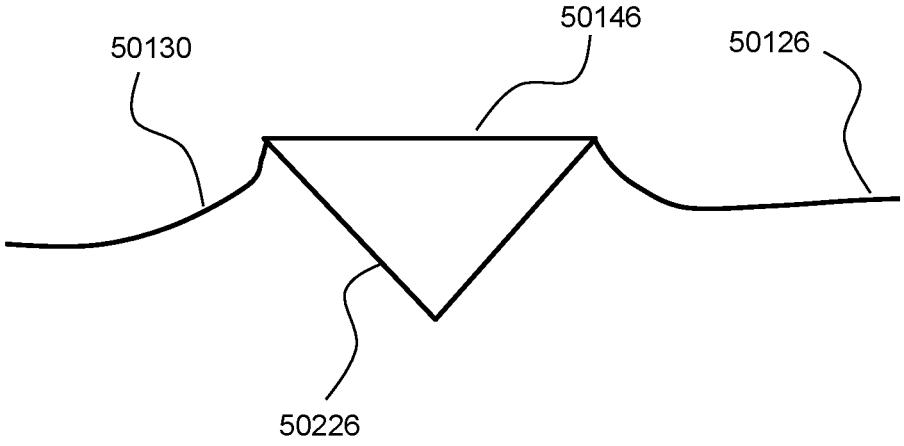

FIG. 50 shows a similar spacer rotated 180 degrees which now creates a concave meniscus 50130 on the liquid surface 50126.

Figure 51:
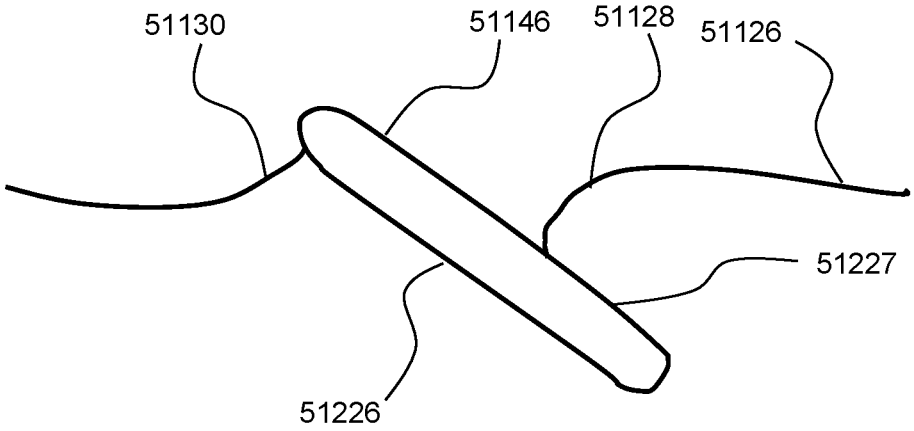

FIG. 51 shows a similar spacer as in FIG. 47 except that the entire cross-section is angled so that it creates a concave meniscus 51130 on one side and a convex meniscus 51128 on the other.

Figure 52:
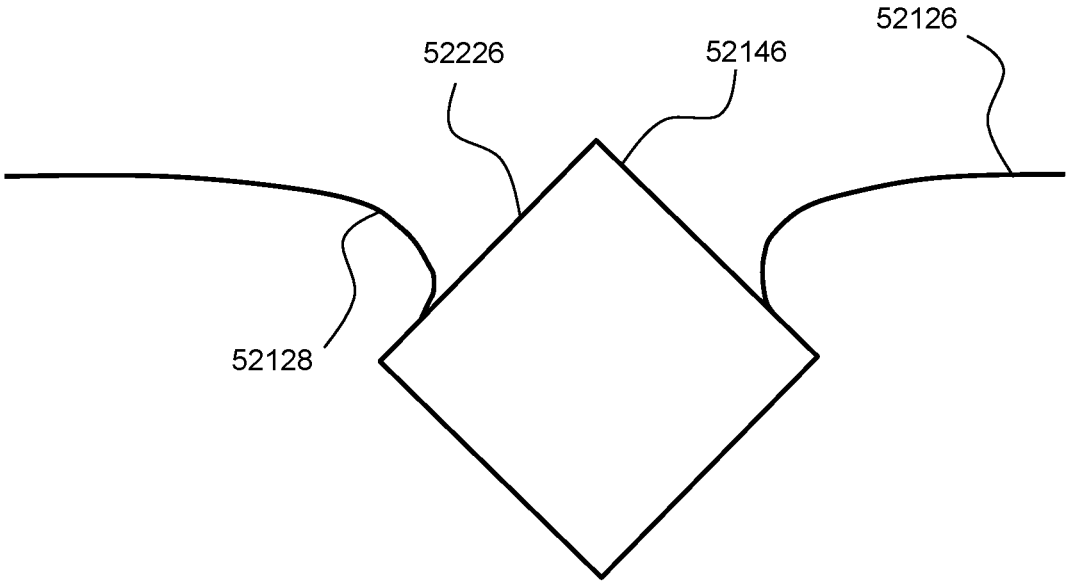

FIG. 52 shows a spacer similar to FIG. 49 accept that the cross-section is symmetrical about a horizontal plane creating a diamond shape.

Figure 53:
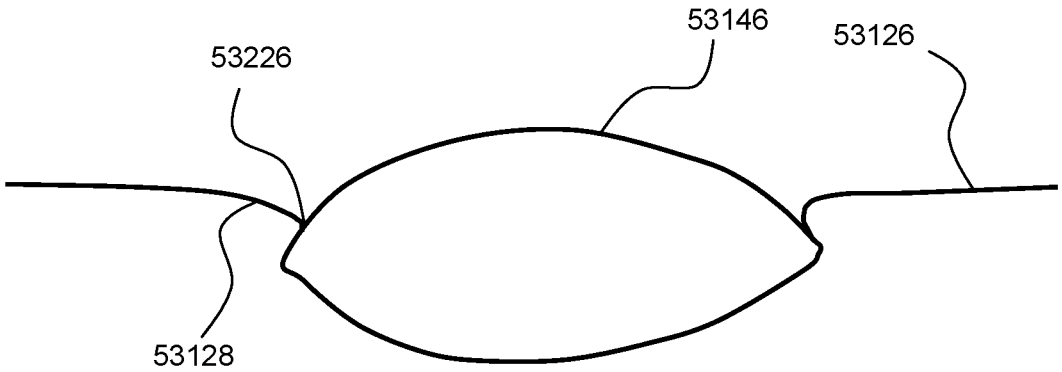

FIG. 53 shows a similar spacer except that instead of a pointed top, it has a rounded top.

Figure 54:
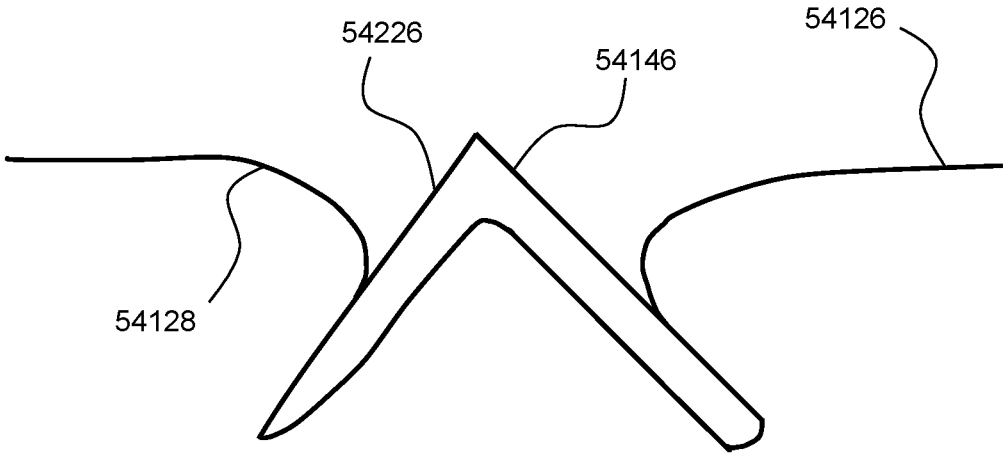

FIG. 54 shows a spacer similar to FIG. 49 except that it has material removed from the bottom of the device.

Figure 55:
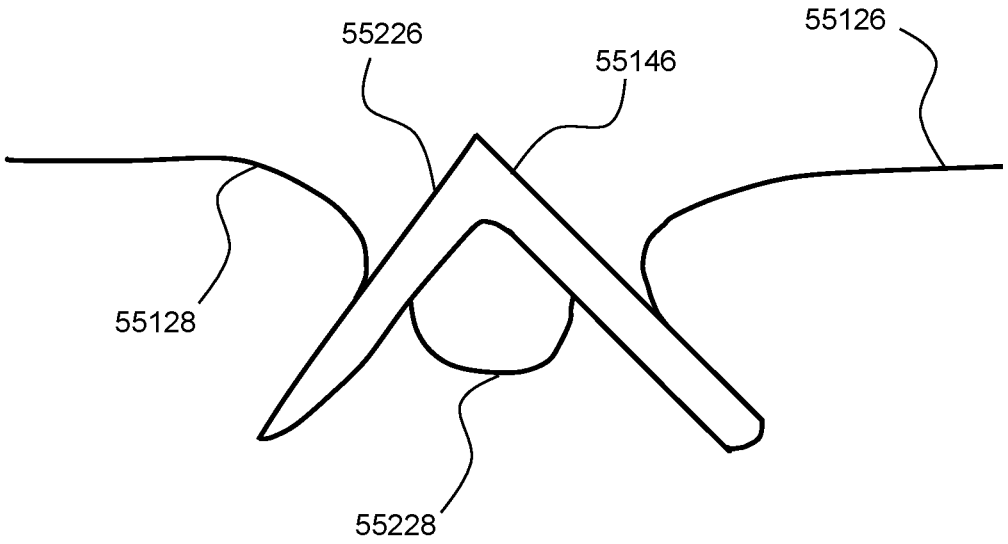

FIG. 55 shows a similar spacer but with an air bubble 55228 trapped below the device.

Figure 56:
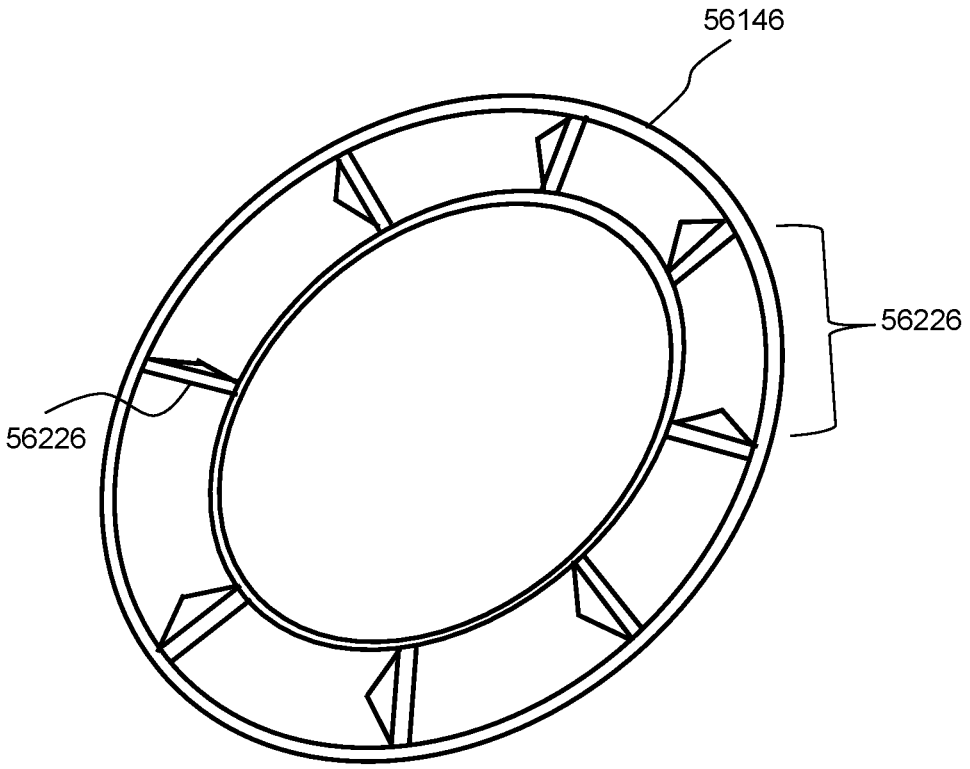

FIG. 56, a perspective view from the bottom left corner, shows a similar cross-section as what is described in FIG. 55, but it is also in the shape of a ring with additional partitioning pieces 56226 that create segmented chambers 56232 underneath the ring.

Figure 57:
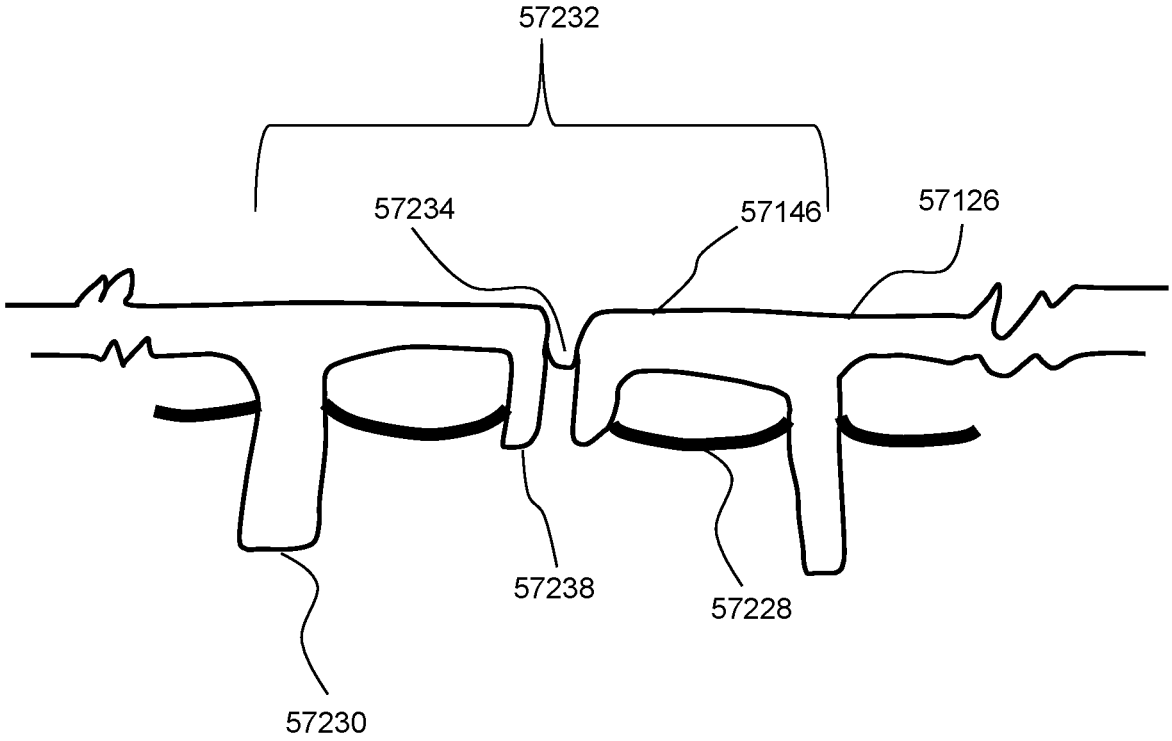

FIG. 57 shows a similar device but at a cross-sectional view perpendicular to the view shown in FIG. 55 and with air bubbles 57228 trapped within the segmented chambers 57232, a vent 57234 for a chamber, and an extended tube 57238.

Figure 58:
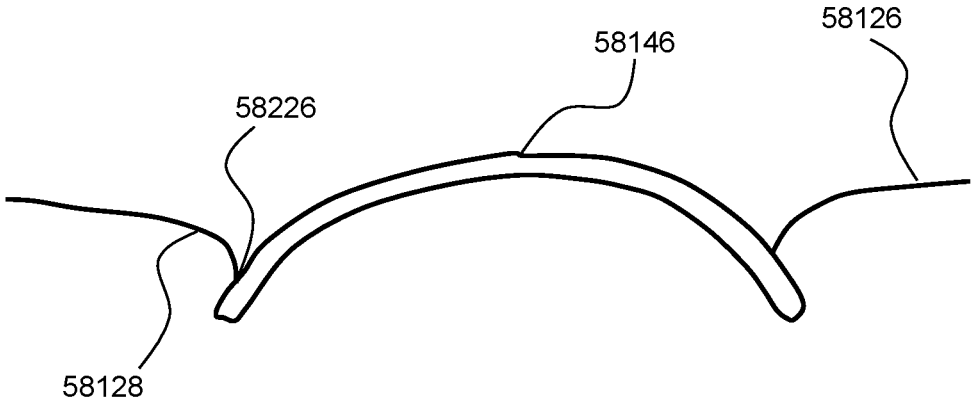

FIG. 58 shows a spacer similar to FIG. 55 but with a rounded top surface 58226 like in FIG. 54.

Figure 59:
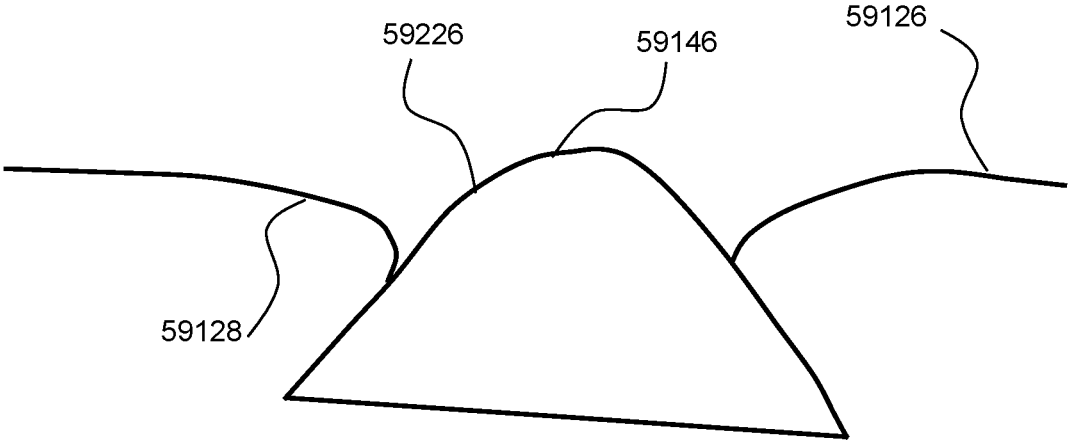

FIG. 59 shows a spacer similar to FIG. 49 but with a rounded top surface 59226 like FIG. 53 but with a smaller bend radius.

Figure 60:
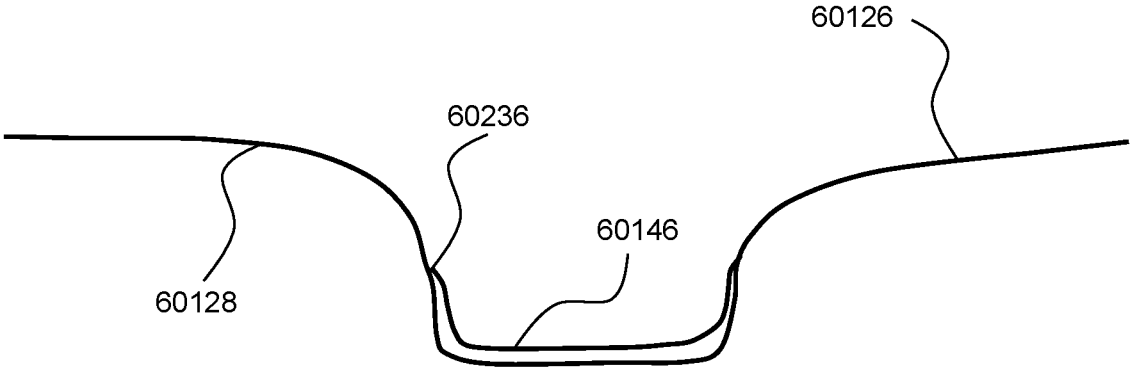

FIG. 60 shows a spacer similar to FIG. 47 except that its water line is well above the entire device, and the liquid surface 60126 attaches to two lips 60236 on each side of the device creating the desired convex meniscus 60128.

Figure 61:
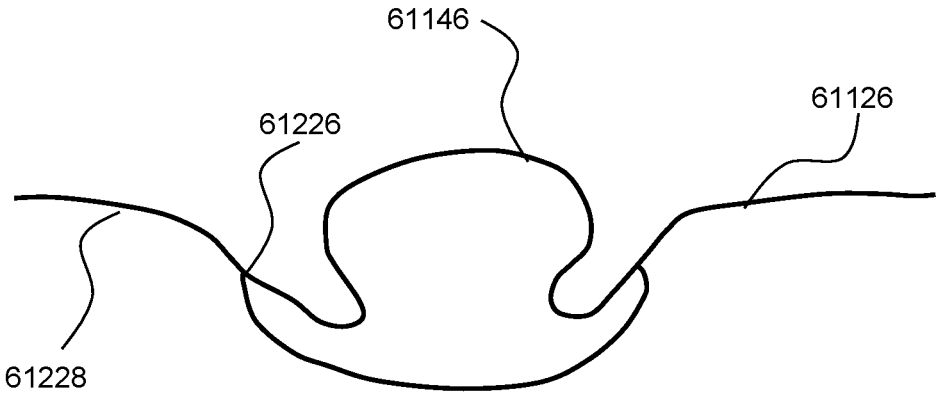

FIG. 61 shows a similar spacer 61146 with a lip 61226 on each side but with shape and a bulk density that allows it to have the horizontal liquid surface line 61126 intersect with the cross-section of the device, creating the desired convex meniscus 61128.

EXPLANATION OF REFERENCE NUMERALS IN DRAWINGS

Closely related references have the same last three digits.

X110 Blade; X112 wick; X114 fuel; X116 Floating candle; X118 Modified tea light cup with blade/s; X120 Modified floating wick body with blades; X122 Air vent; X124 Container; X126 Liquid surface or Liquid and Air interface; X128 Convex liquid surface; X130 Concave liquid surface; X132 Wick Stand; X134 self-propelled Tea light device; X136 Angled Container rim; X138 Extended container wall; X140 Self-propelled oil lamp device; X142 Container wall; X144 Counter weight; X146 floating Separator/Spacer; X148 Self-propelled floating candle device; X150 Tea light side brace or tea light side support ledge; X152 Tea light bottom support bump; X154 Floating Tea light holder; X156 Insertable tea light brace; X158 Tea light; X160 Multi wick toroidal self-propelled floating candle; X162 Right Handed self-propelled tea light device; X164 Left Handed self-propelled tea light device; X166 Keel; X168 Mast; X170 Sail; X172 Boom; X174 Rudder; X176 Gaff; X178 Separator connecting piece; X180 Blade supports; X182 Cut-out Advertisement; X184 light source; X186 Projection Surface; X188 Projected image; X190 Second Immiscible Liquid; X192 Liquid-Liquid interface; X194 Extended rim; X196 Fuel channel; X198 Roll preventer; X200 Focal points; X202 Power source/Battery; X204 Resister; X206 Wire; X208 Induction coil; X210 AC power source; X212 AC powered floating resister device; and X214 Internal container.

DETAILED DESCRIPTION

Figure 1:
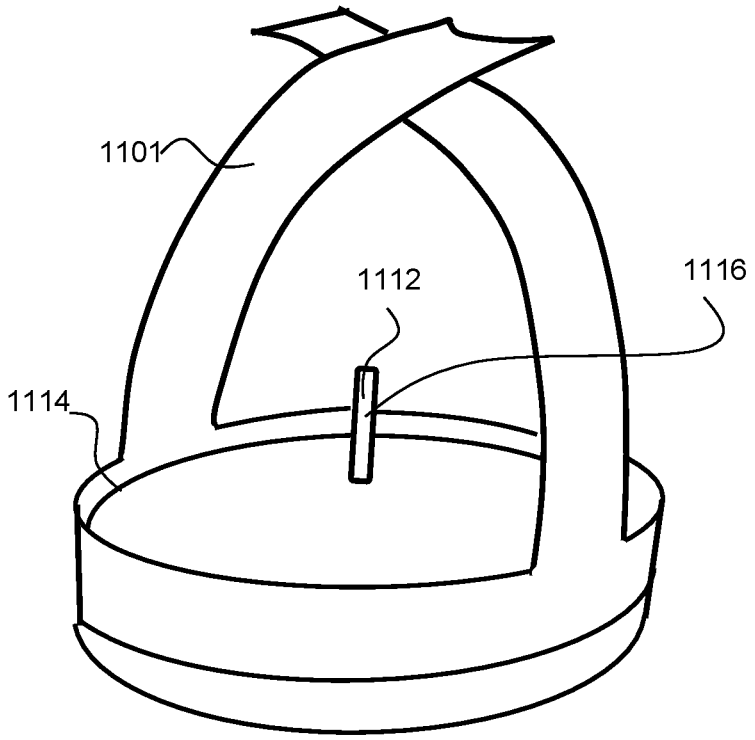
Figure 2:
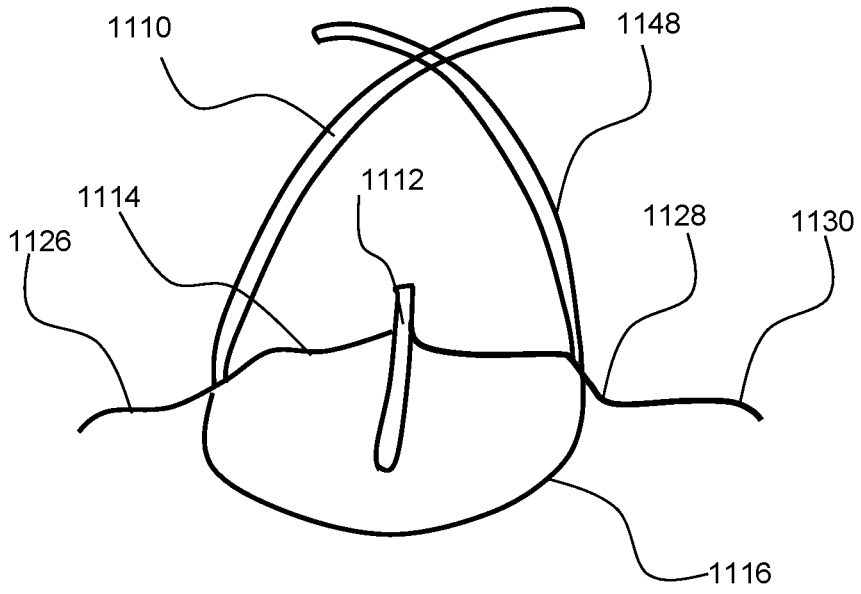

FIGS. 1 and 2—First Embodiment

One embodiment of the machine illustrated in FIG. 1 (perspective view) and FIG. 2 (cross-sectional view from the side in a body of liquid). The machine has floating base and a blade or blades 1110 attached to the floating base. The device is also designed so that as device floats in a liquid it is stable enough to hold the blade or blades above the liquid, and it is also able to form a meniscus along the outside perimeter of the floating base which is mostly either concave or convex. In one embodiment, the floating base can be in the form of a floating candle 1116 which consists of a wick 1112 and fuel 1114 which can be in the form of solid wax, and a blade/s 1110 that are attached to the float can extend above a potential heat source. The blade or blades can be made out of a material able to hold its position above a heat source and be light enough as to not make the entire float unstable. In one embodiment the blade or blades can be made out of 4 mil aluminum shim stock, but also could be made out of other metals (brass, steel, etc.), ceramic material (glass, porcelain etc.), polymers and plastics, feathers, wood and wood-based products (fire resistant rice paper). Less heat resistant materials could be used as long as the device is designed to work with a heat source that is well controlled. In the case of a wicked flame, the type and size of the wick as well as the type of wax and access to oxygen can all affect the size and quality of the heat source. These details of wick design will be excluded since those details are obvious to those familiar with the art. In FIG. 1 the material making the blades is formed into a special shape that also surrounds the floating candle 1116 to create a surface for the meniscus to form when it is placed in a liquid. This special shape is not necessary for the device to function properly, but it is only required that the liquid is designed to make an either concave or convex meniscus along the perimeter of the floating base of the object and the blades are attached to the floating base which can be held above a heat source.

FIG. 2 is cross-sectional view from the side where the machine mentioned in FIG. 1 is placed on the surface of a body of liquid 1126. If the liquid is water, and the surface is a metal such as aluminum with a smooth finish that is clean, the liquid water will form a concave meniscus 1130 along the perimeter of the machine 1148. Since the object has a concave meniscus, it must be surrounded or mostly surrounded by an opposing convex meniscus 1128 which can be formed in various ways which will be described in detail in the coming sections. Note, that if the machine was made to have a convex meniscus along its perimeter, then it must be surrounded or mostly surrounded by a concave meniscus. Thus it is only required that the meniscus adjacent to the device be opposing the type of curvature of the other immediate areas of the liquid surface.

Operation—FIGS. 1 and 2

In operation one places the machine into an area that has still or near still air and onto an appropriate liquid surface 12126 of a liquid that is dense enough to allow the machine to float and a heat source is held below a blade or blades of the device.

If the liquid surface is large enough and there is no other disturbance in the liquid surface near the machine other than the meniscus created by the device, the device will move as long as a large enough heat source is applied below a blade or blades. Depending on the design of the blades, the device can be made rotate, move linearly, or both rotate and move linearly. If the device rotates and moves linearly, it will appear as the object is moving along a curve, because as the device is rotating, it is also changing the direction of which it is moving linearly because of the position of the blades.

The device moves because the heat source causes the local surrounding air or similar fluid to raise temperature. As the temperature is raised the fluid moves or flows in a direction parallel to the force of gravity because of buoyancy (either upwards or downwards depending on how the density changes) only if the surrounding fluid has a non-zero thermal expansion coefficient and the fluid is not viscous enough to resist such flow. The same effect can occur if it is a cold source. One example of this effect is a lit candle. The lit candle creates a small upwards flow of air because the local air around the flame rises because the warmed air is less dense than the surrounding air because of its thermal expansion coefficient.

If the surface of the liquid is not large, or there is another disturbance in the liquid surface, specific criteria must be met for the device to operate properly. These criteria are not difficult to satisfy, but the user must be aware of them to avoid an unexpected result.

To start, it may be easier to describe what can go wrong. A floating object that creates a meniscus on a liquid surface can be attracted to another object in contact with the same liquid surface. This effect is known in some groups as a capillary force, and more commonly known as the cheerio effect. This attractive force results when the two objects create menisci, where both objects either create concave menisci or both objects create convex menisci. If the described device in FIG. 1 created a concave meniscus in a liquid near another objected that also created a concave meniscus, the two objects will attract one another, and if they are able, move closer to one another. When they are in close proximity or contact, the device can cease to move. This is undesirable and is probably the reason why others have tried to use magnets and or motors, to create a reliable floating spinning candle device. However, this capillary force effect has a little-known property that can be used to not only fix the potential problem, but to also keep the floating object away from other places on the liquid surface. The property that is useful occurs when one meniscus is concave and another on the same liquid surface is convex. If this situation occurs between an object and another object, then the object will be repelled (instead of attracted like cheerios in a bowl of milk) by the other object. All that is necessary is that the meniscus curvatures be opposing (i.e. a meniscus of one object is concave, and the meniscus of another object in contact with the same liquid surface is convex). There are many ways to take advantage of this effect to create and reproducibly operate the novel devices that are presented in this document. There are ways to enable the object to operate successfully without having the curved meniscus be either entirely concave or entirely convex along its perimeter, but it is in general better to design the device to purposely have a meniscus be entirely either concave or entirely convex along a perimeter (either internal or external) on a liquid surface.

When designing objects in contact with liquid surface or liquid interfaces, one can change the orientation of the meniscus by carefully selecting the surface properties of the object in contact with the liquid surface or liquid interface and/or the angle at which the object comes into contact with the liquid surface or liquid interface. If the shape, intended orientation, and bulk density of a floating object is known as well as the wetting properties of the specific surface of the solid or solids of the floating object intended to be in contact with the intended liquid surface or liquid interface are known then the range of possible menisci for the system can be predicted.

The wetting angle is a common way to define the wetting properties of a group of phases. The wetting angle is commonly defined in terms of the contact of three phases which are usually liquid-vapor-solid, but there are other combinations that are possible. This document is mostly concerned with a liquid-air-solid interface and a liquid-liquid-solid interface.

There are experimental methods to determine the range of wetting angles that are possible for a given three phase system (liquid-gas-solid, or liquid-liquid-solid). The angles bounding this range are called the advancing wetting angle and the receding wetting angle. From this range, the equilibrium wetting angle can be predicted. These angles can be used to aid in design of the floating object so that the floating will create the desired concave or convex meniscus. Various different surface finishes (such as PM-F1, SPI-C1, SPI-B1, SPI-A2, PM-T1, PM-T2 for polypropylene from Proto Labs®) and coatings (such as Ultra-Ever Dry®) can change these angle values for a given type of solid material.

The specific operation of the device as shown in FIGS. 1 and 2 starts by placing the self-propelled floating candle on the surface of the liquid in a place where its concave meniscus that forms in the liquid is surrounded by a convex meniscus. The heat source, even though can be external to the device, can be added simply in this case by lighting the wick 1112 of the floating candle 1116 by a match. The newly created flame will heat the surrounding still air and cause the air to rise because of buoyancy. The direction of the stream of rising hot air is altered by the blade or blades 1110. As the blades change the direction of the air stream, a force and or torque is applied to the blades by the moving air stream since it is changing direction. The resultant force and/or torque on the blades causes the entire self-propelled floating candle device 1148 to move linearly and/or rotate. In the arrangement of FIGS. 1 and 2 the device will mostly rotate instead of moving linearly in one direction.

To make an embodiment move linearly, one blade can be removed and the device will move in the opposite horizontal direction as the horizontal direction of the air stream modified by the blade. To have the device rotate and move linearly, one could simply put a slight twist in the single blade directly above wick 1112.

Figure 3:
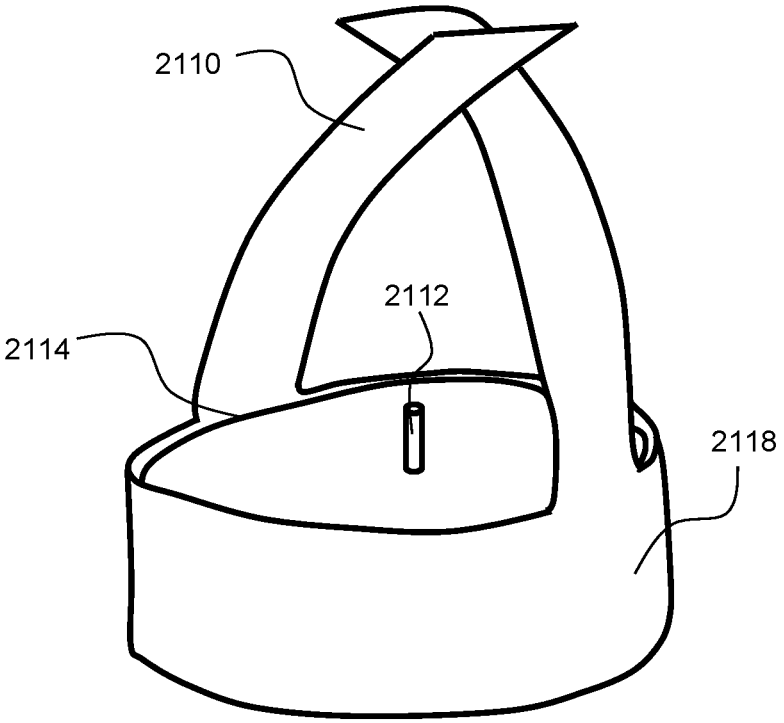
Figure 4:
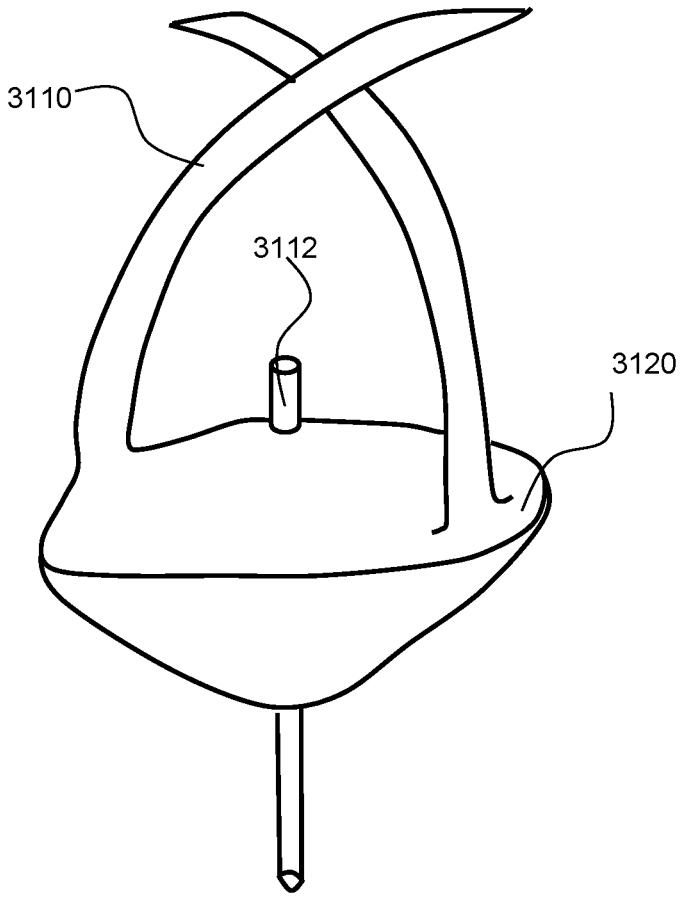
Figure 5:
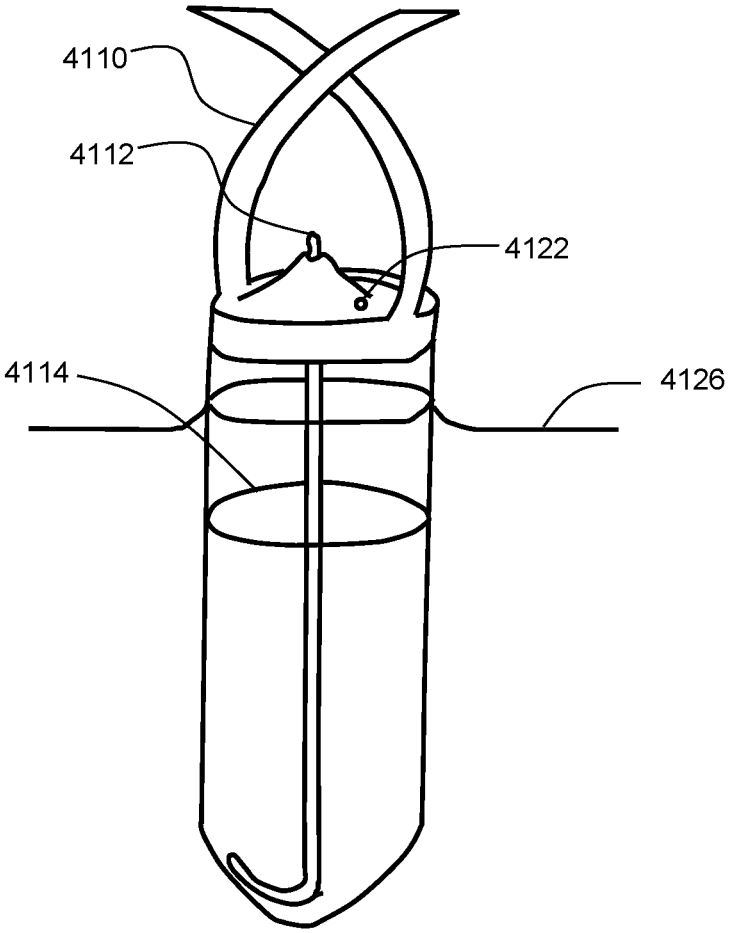

FIGS. 3-5—Additional Embodiments of the Floating Body with Blades

FIGS. 3-5 illustrates other embodiments that are alternative to the floating body as shown in FIGS. 1 and 2. FIG. 3 illustrates a heat source container which is a floating body in the form of a modified tea light. The tea light has a modified tea light cup 2118 that have blades that extend above the wick 2112. FIG. 4 illustrates a floating wick with a modified body 3120 with blades 3110. FIG. 5 illustrates a floating oil lamp where a liquid oil fuel 4114 is placed inside the device. The device also can have an air vent to prevent a vacuum from being created inside the lamp and can also be used to control flame height.

Operation—Additional Embodiments of the Floating Body with Blades

The other embodiment of FIG. 3 operates in much the same way as the embodiment in FIGS. 1 and 2. The other embodiment of FIG. 4 can operate by being placed in a liquid that can also act as a fuel for the wick. The other embodiment of FIG. 5 operates similar to FIGS. 1 and 2 and the liquid fuel placed within the device must not be filled so high as to make the device unstable.

FIGS. 5-10 Containers

FIGS. 6-11 illustrate (in cross-sectional views from the side) various ways outer objects in the form of containers can be used to create a liquid surface with the proper curvature to allow a functional embodiment.

Figure 6:
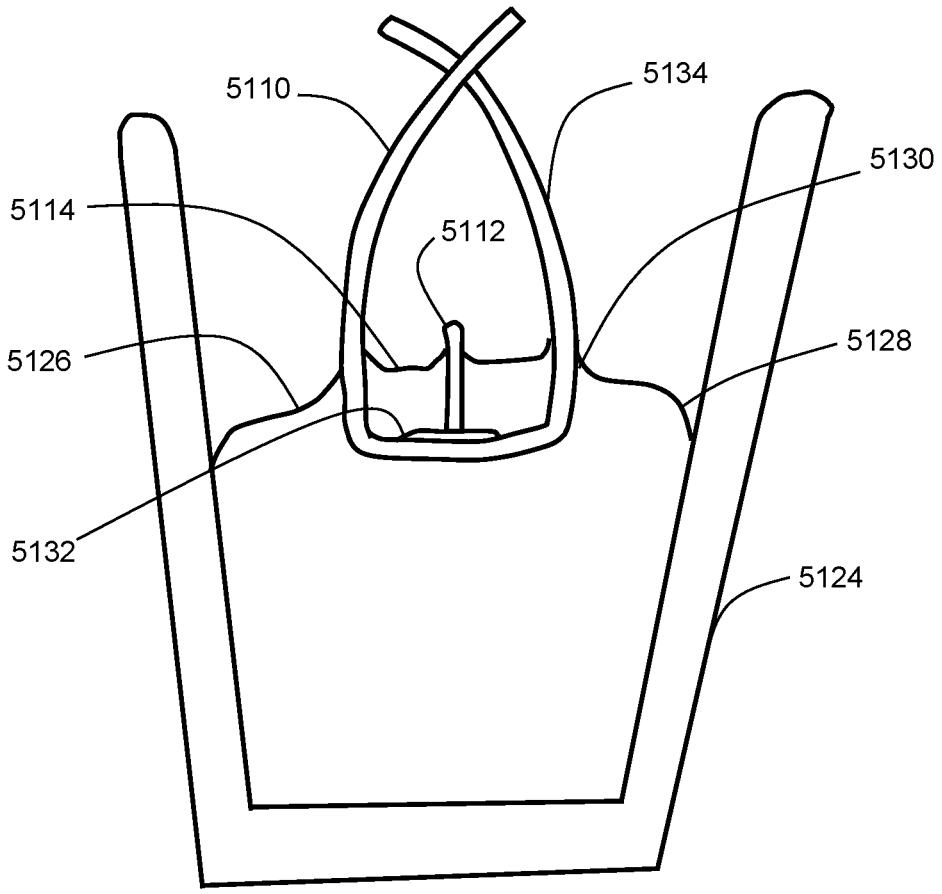

FIG. 6 in a cross-sectional view from the side, illustrates a self-propelled floating tea light device 5134 similar to what is described in FIG. 3 placed on top of a liquid surface 5126 within a container 5124 in the shape of a cup. In this embodiment the self-propelled floating tea light device creates a concave meniscus 5130 on the liquid surface along its perimeter, and the container creates a convex meniscus along its perimeter of the liquid surface adjacent to the self-propelled floating tea light device 5134. There can be a wick stand 5132 within the tea light as known by those familiar with the art.

Figure 7:
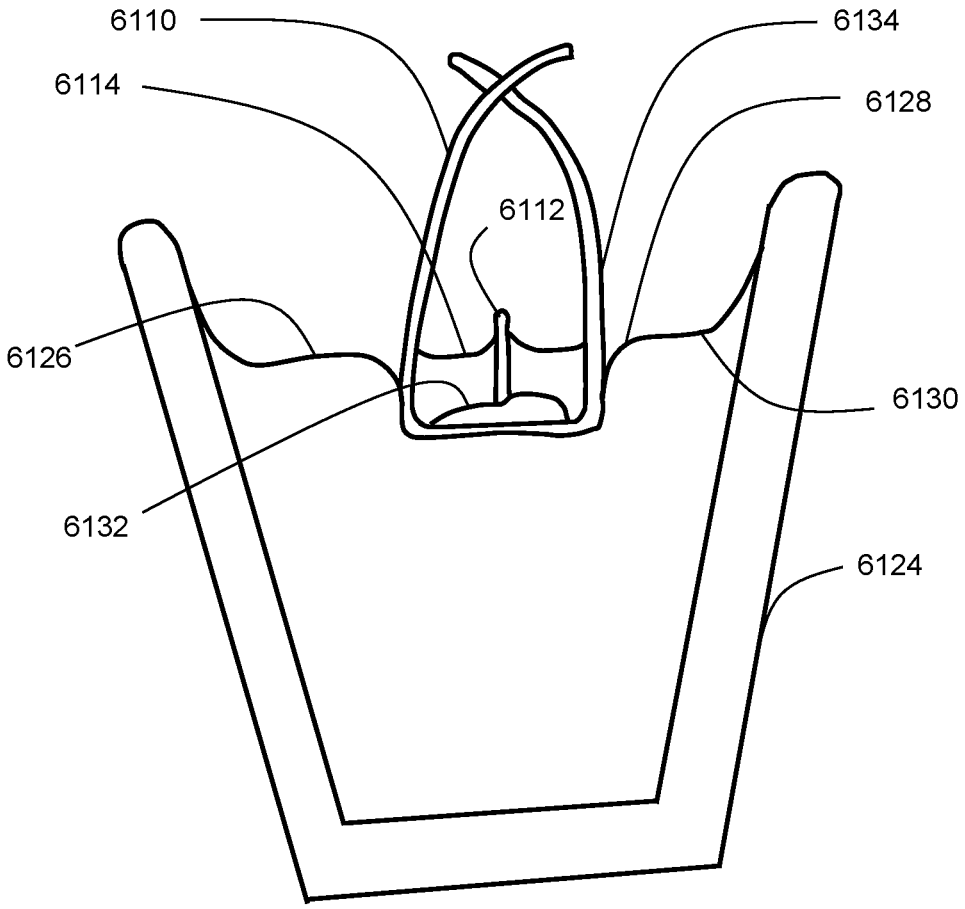

FIG. 7 shows another embodiment of a similar arrangement, but now the concave meniscus 6130 is now along the container wall, and the convex liquid meniscus 6128 is now along the self-propelled floating tea light device 6134.

Figure 8:
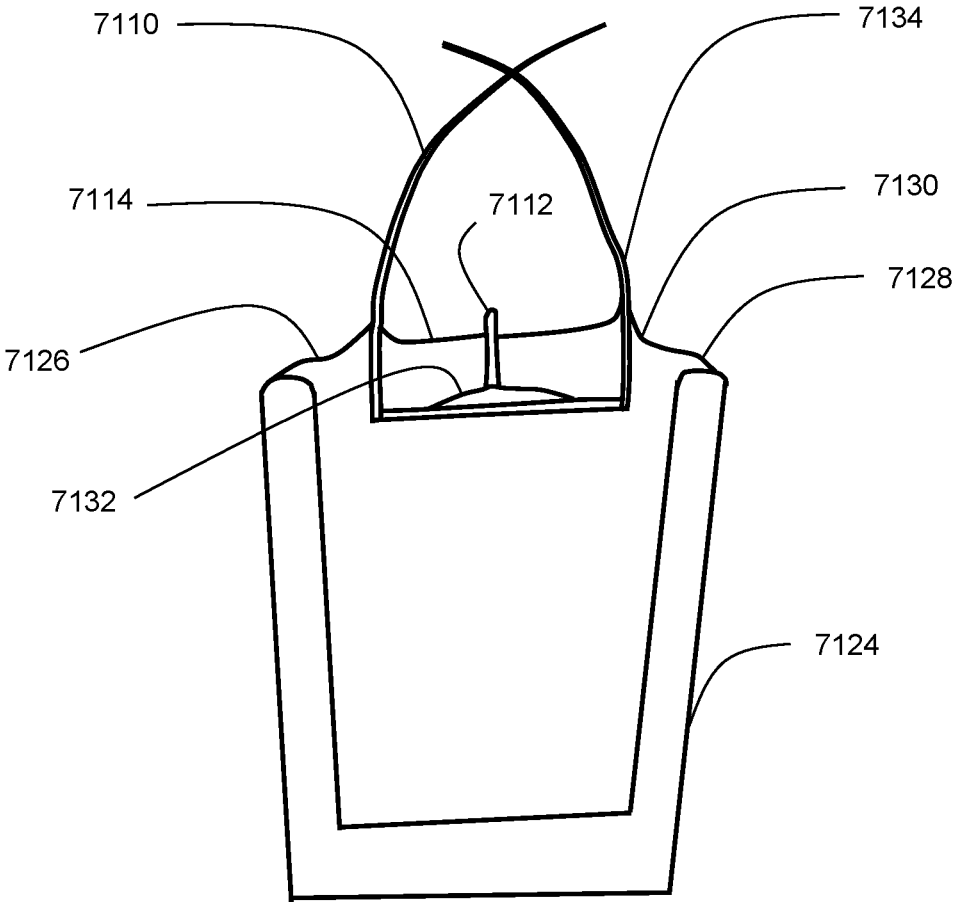

FIG. 8 shows another embodiment of a similar arrangement to FIG. 6, but now the liquid is filled to the brim of the container 7124, and as the liquid bulges above the rim, it creates a convex meniscus 7128. FIG. 8 could also be thought as similar to the arrangement of FIG. 7, but now the modified tea light device is made designed to create a concave meniscus instead of a convex meniscus.

Figure 9:
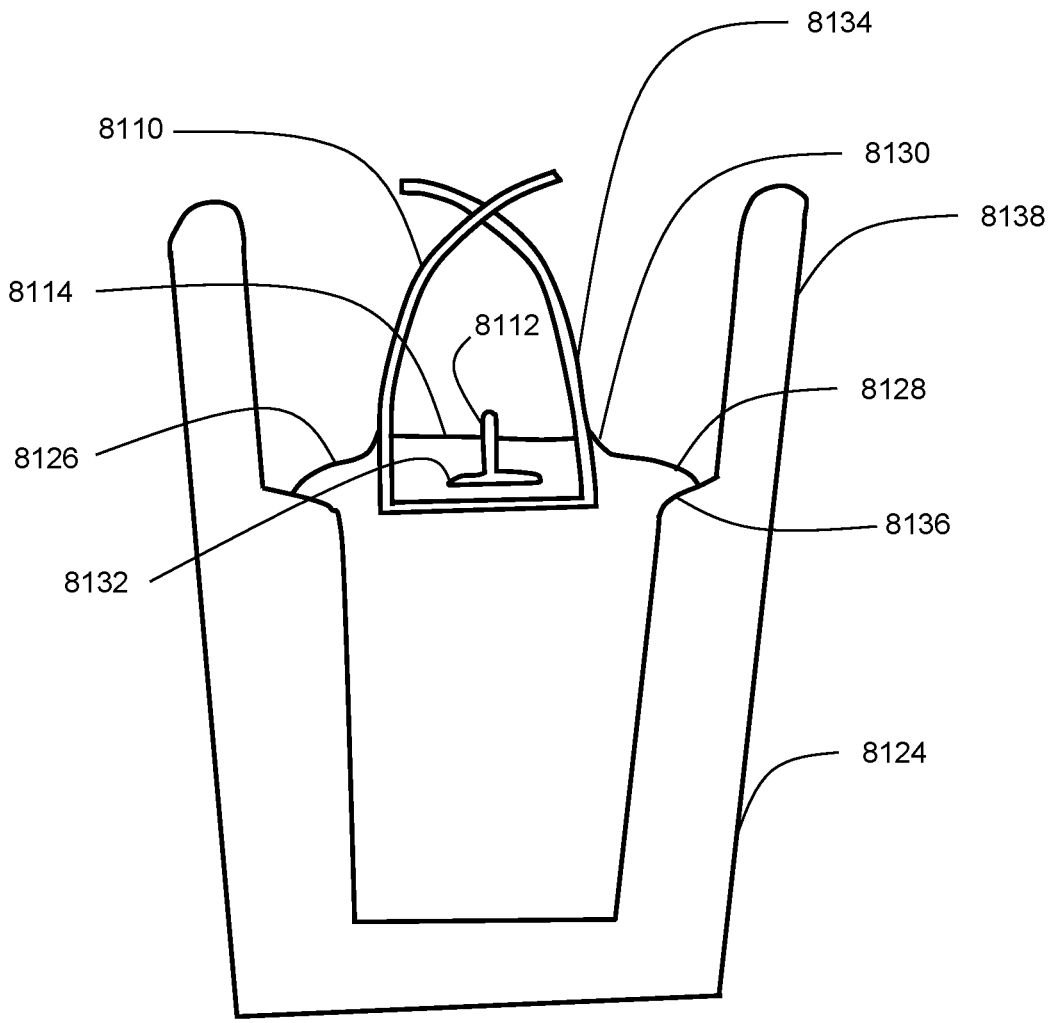

FIG. 9 shows another embodiment with a modified container 8124 with an angled rim 8136 along the liquid interface and an extended container wall 8138.

Figure 10:
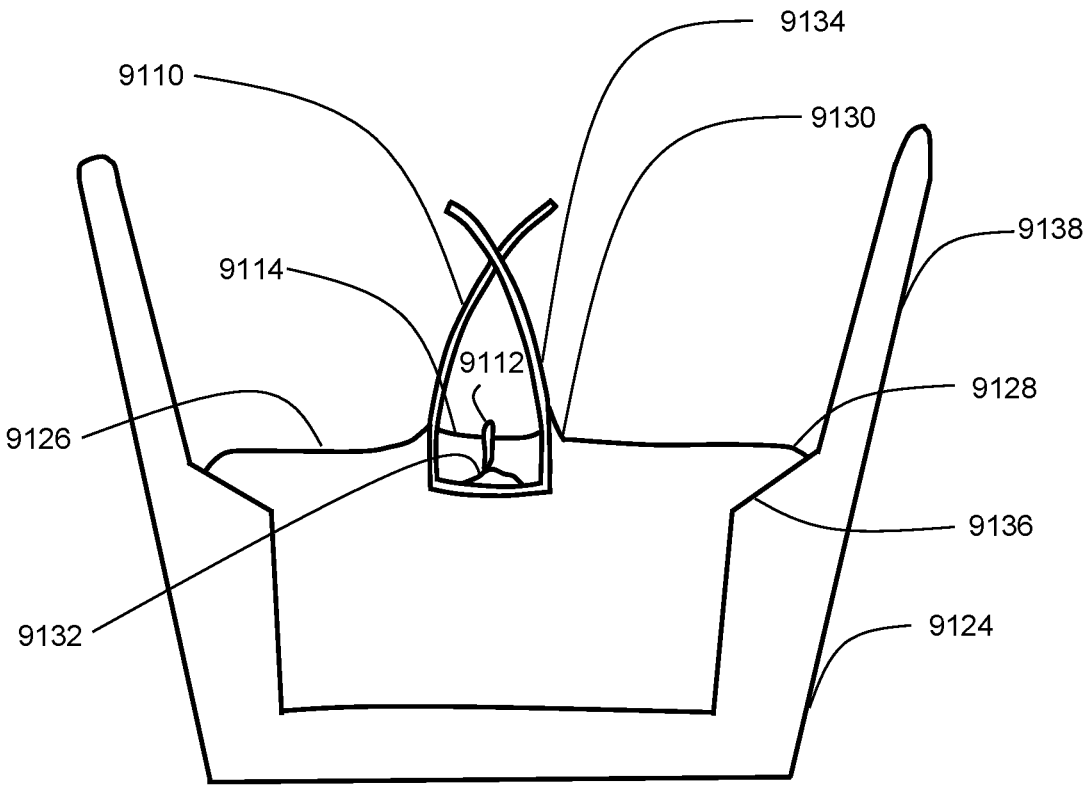

FIG. 10 shows a similar embodiment with a container 9124 whose diameter is much larger than the diameter of the floating tea light device 9134.

Figure 11:
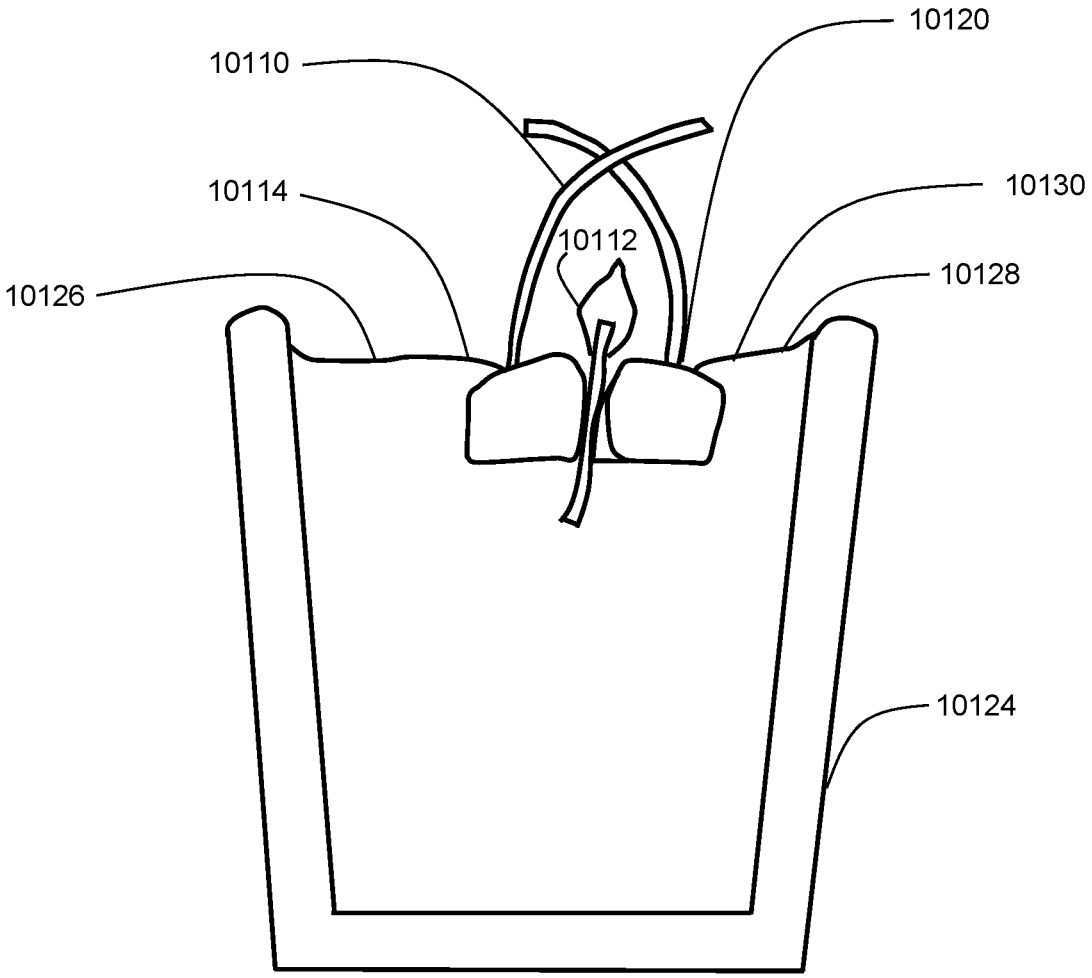

FIG. 11 illustrates another embodiment where there is a self-propelled floating wick 10120 device in a container 10124 of liquid fuel 10114. The liquid fuel creates a convex meniscus 10128 along the self-propelled floating wick device 10120 and the liquid fuel also creates a concave meniscus 10130 along the perimeter of the container 10124.

Operation—Containers

In FIGS. 6, 7 and 11, the container is placed on a level or near level surface in an area with still or near still air. A liquid is poured into the container so that it creates the desired meniscus effect on the container wall. In the case of FIGS. 7 and 11, the liquid is designed to create a concave meniscus on the wall of the container, and FIG. 6 is designed to create a convex meniscus on the wall of the container. In each case, a self-propelled floating device with well-chosen wetting properties is placed on top of the liquid so that the self-propelled floating device creates a meniscus on the liquid that is opposite in curvature of liquid meniscus along the container wall. For example, in FIGS. 7 and 11, the device would need to create a convex meniscus along the surface, because both containers in each of the figures creates a concave meniscus along its perimeter, and in FIG. 6, the floating device would need to create a concave meniscus along its perimeter in the fluid since the container shown in the figure creates a convex meniscus along its perimeter. In FIGS. 7 and 11, the amount of liquid initially poured into the container must not be so much as to bulge out over top of the container when the floating device is placed on top of the liquid surface. In FIGS. 6, 7, and 11, the liquid initially poured into the container must not be so little that the device placed on the liquid touches the bottom of the container. This will cause friction making it difficult for the device to move. Floating device once placed into the containers, is repelled by the walls of the containers because of the liquid surface capillary effects and once lit is able to move freely in a manner determined by the shape of its blades in a method similar to the other embodiments mentioned.

It should be noted that the operation of FIG. 11, the floating device does not change buoyancy as the fuel burns because nothing is consumed on the floating object as the wick burns (unless the wick is being slightly consumed). It is also worth noting that the fuel source can be as large as needed, only a larger container is needed to increase the burn time.

FIG. 8 shows a similar embodiment of an arrangement that operates similarly and shows a floating device that creates a concave meniscus along its perimeter. A container that normally creates a concave meniscus along its walls can still be used except that liquid is filled so that the liquid surface fills to just above the brim of the container when the floating device is placed on the surface thereby creating a convex meniscus along the edge of the container instead of a concave meniscus. Note that the wetting angle between the solid container and the liquid is still small even though it creates a convex meniscus on the liquid surface.

FIGS. 9 and 10, show a similar embodiment that operates similarly except that instead of filling the container to the brim of a container, the liquid can be filled to an angled section (8136, 9136) of the container (8124, 9124) that still creates the desired meniscus except now it is much more difficult to spill the liquid because of the extended container wall (8138, 9138). FIG. 10 shows a larger container 9124 that is more forgiving as the fuel burns and changes the liquid level. The same effect can be achieved by using a container in the shape of a bowl whose walls are at an angle that creates the desired meniscus effect along the entire length of the wall.

FIGS. 8, 9, and 10 are mentioned to show how a container shape can be used to create the desired meniscus effect even when its surface wetting properties are not ideal or special coatings are not available to alter the wetting angle.

FIGS. 12-15, FIGS. 29-33, and FIGS. 47-61—Spacers

Figure 12:
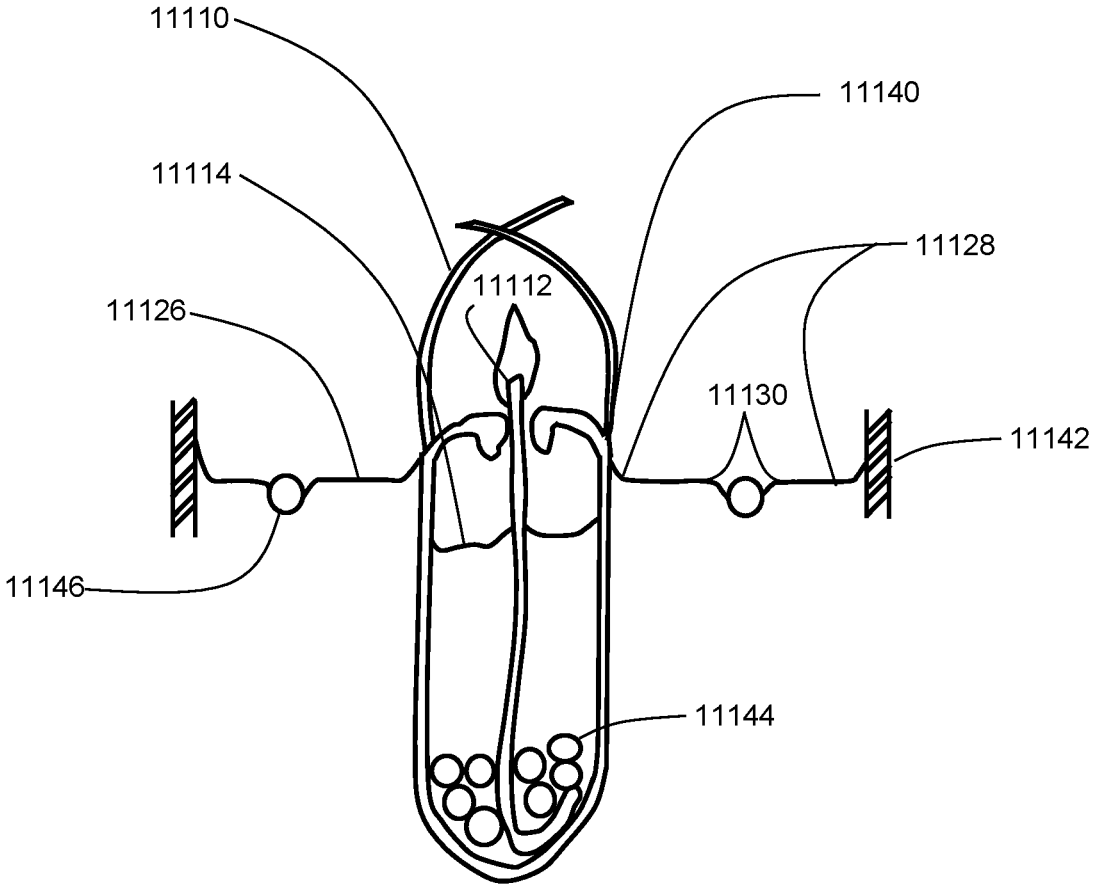
Figure 13:
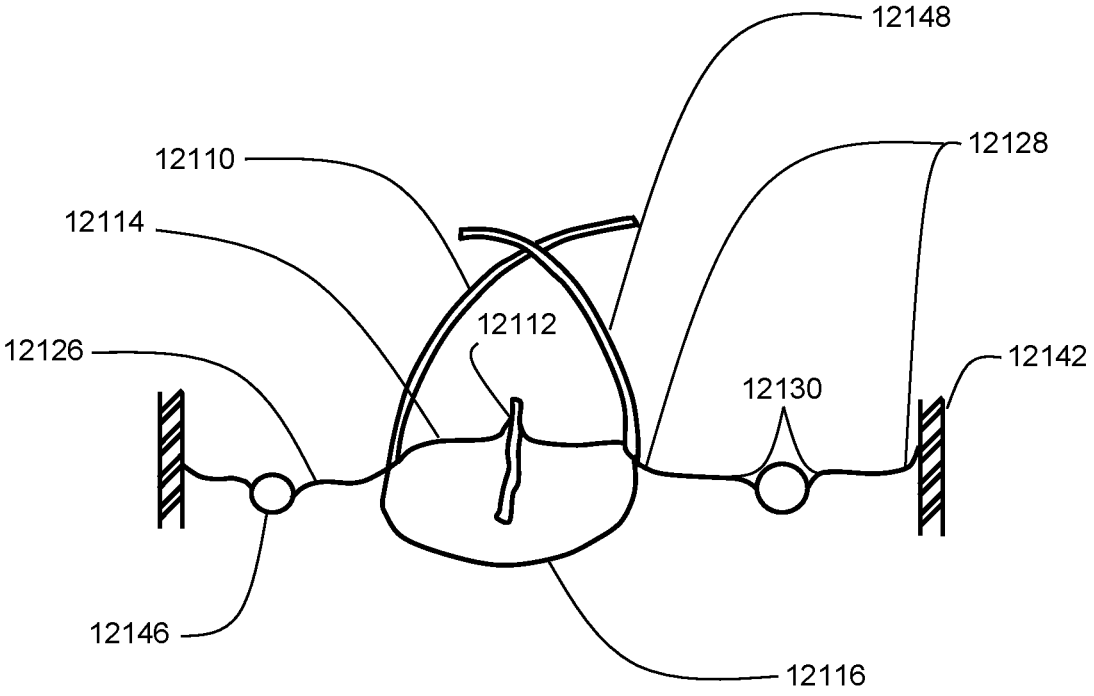
FIG. 13 shows a similar arrangement where the floating oil lamp is replaced with a floating candle constructed in accordance with an embodiment.
Figure 14:
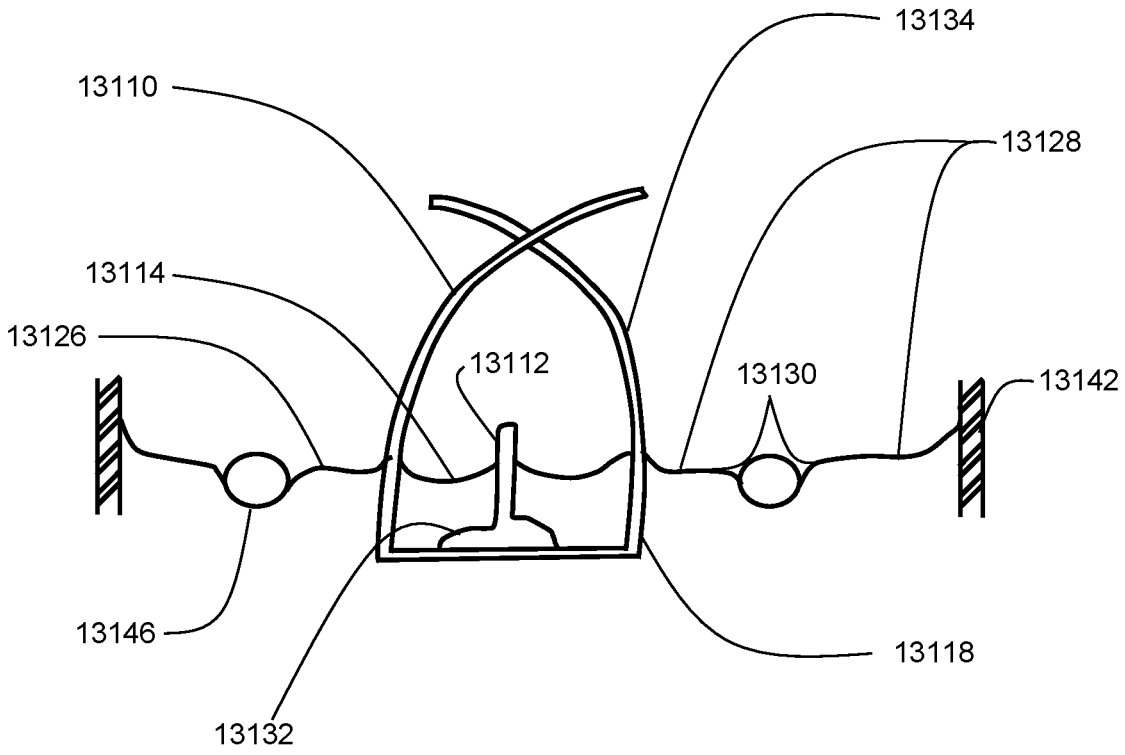
FIG. 14 shows a similar arrangement where the floating oil lamp is replaced with a floating modified tea light constructed in accordance with an embodiment.

FIGS. 12-14 illustrate cross-sectional views from the side of other embodiments where a self-propelled floating device (11140, 12148, 13134) similar to those shown in FIGS. 5, 1, and 3, respectively, are placed on the liquid surface within a container where the direction of curvature of the liquid meniscus is the same for the container wall and the self-propelled floating device. In each case an outer object in the form of a spacer ring (11146, 12146, 13146) with a circular cross-section is placed on the liquid that creates an opposing curvature of the liquid meniscus along the perimeter of the floating object, and is placed in a position so that it surrounds the self-propelled floating device and therefore creating an opposing curvature liquid meniscus surrounding the self-propelled floating device.

FIGS. 29 through 33 show more intricate spacers that can create additional effects. FIGS. 29 and 30 (FIG. 29 in a perspective view and FIG. 30 in a cross-sectional view from the side) illustrate an arrangement of another embodiment that creates a path for a self-propelled floating device to travel along. It is constructed in the shape of two spacer rings 28146 that are connected by pieces 28178 that do not interfere with the movement of the self-propelled floating tea light device 28134. Note that the self-propelled floating tea light device 28134 creates a concave meniscus 28130 along its perimeter, the floating spacer creates an opposing convex meniscus 28128 along its inside perimeter which surrounds and encloses the self-propelled floating device. The floating spacer also creates a convex meniscus along its outside perimeter which opposes the curvature of the concave meniscus along the container wall 28142.

FIG. 31 shows a similar arrangement of another embodiment that creates an even more intricate pathway for the self-propelled floating tea light device 30134.

FIG. 32 illustrates a modified self-propelled wick holding device with a blade constructed in accordance with an embodiment that creates a concave meniscus around its perimeter and is surrounded by a rectangular shaped spacer which creates a convex meniscus on its inside perimeter and on one side of its outside perimeter and a concave meniscus on the three other sides of its outside perimeter which is able to travel with the modified self-propelled wick holding device along a path created by two linear spacers that create a convex meniscus on the liquid surface which is also accompanied by another similar modified tea light and rectangular spacer within the same space between the two linear spacers.

As illustrated in FIG. 32, an embodiment may use combinations of spacers 31146, 31147 and self-propelled floating tea light devices 31134. Except for the lines showing the outline for the blades 31110 which extend out over top of the liquid, solid lines represent perimeters that create convex menisci along a liquid surface, and dot-dash lines represent perimeters that create concave menisci along a liquid surface. The spacers 31147 immediately surrounding the self-propelled floating tea light devices 31134 are in the general shape of a rectangle, where three of the outside edges of the rectangle create concave menisci and the fourth side creates a convex meniscus. Note that this fourth side with a convex meniscus is not directly adjacent to the spacer rails creating also creating a convex meniscus. Note that the fourth side with a convex meniscus can be directly adjacent to the edge of another rectangular spacer which creates a concave meniscus. The inside edges of the rectangular spacer 31147 create a convex meniscus along its inside perimeter which is opposes the curvature of the concave meniscus created by the self-propelled floating tea light device 31134. The two spacer rails 31146 which create convex menisci on the liquid surface are held apart from each other (one way can be using connecting pieces shown earlier), and create a path for the two self-propelled floating tea light devices 31134 to travel. In this way, as long as the two spacer rails are held apart (such as a connecting piece described earlier), all floating objects create menisci that are opposing in curvature to other menisci that are directly adjacent. For example, the self-propelled floating tea light device 31134 creates a concave meniscus along its perimeter, which is opposing in curvature as the adjacent meniscus along the inside perimeter of the rectangular spacer, which creates a concave meniscus along the outside edges that are opposing in curvature and directly adjacent to spacer rails which create convex menisci, and rectangular spacers create opposing menisci directly adjacent to one another.

FIG. 33 shows a similar arrangement of another embodiment which has specially shaped self-propelled floating tea light devices 32134 and specially shaped spacers 32147 surrounding the self-propelled floating tea light devices 32134 where the length of the self-propelled floating devices is larger than the inside width of the floating spacer 32147.

FIGS. 47-62 illustrate various ways spacers can be used to obtain the desired meniscus curvature with many materials with or without their various surface finishes or coatings.

FIG. 47 shows a cross-sectional view from the side of a spacer similar to the spacer with a circular cross-section as shown in other embodiments which can be part of a ring as shown in other embodiments torus shaped. Note that in this figure the liquid surface 47126 forms a convex meniscus 47128 against the spacer 47146 and the surface 47226 of the spacer 47146 is angled so that it is vertical.

FIG. 48 shows a similar spacer 48146 creating a concave meniscus 48130 on the liquid surface 48126 with a similarly vertical surface 48226.

FIG. 49 shows a spacer 49146 similar to that of FIG. 47 except that it has much a much less steep angled surface 49226 on each side forming the general shape of a triangle.

FIG. 50 shows a similar spacer rotated 180 degrees which now creates a concave meniscus 50130 on the liquid surface 50126.

FIG. 51 shows a similar spacer as in FIG. 47 except that the entire cross-section is angled so that it creates a concave meniscus 51130 on one side and a convex meniscus 51128 on the other.

FIG. 52 shows a spacer similar to FIG. 49 accept that the cross-section is symmetrical about a horizontal plane creating a diamond shape.

FIG. 53 shows a similar spacer except that instead of a pointed top, it has a rounded top.

FIG. 54 shows a spacer similar to FIG. 49 except that it has material removed from the bottom of the device.

FIG. 55 shows a similar spacer but with an air bubble 55228 trapped below the device.

FIG. 56 shows in a perspective view from the bottom left corner, a with a similar cross-section as what is described in FIG. 55, but it is also in the shape of a ring with additional partitioning pieces 56226 that create segmented chambers 56232 underneath the ring.

FIG. 57 shows a similar device but at a cross-sectional view perpendicular to the view shown in FIG. 55, and with air bubbles 57228 trapped within the segmented chambers 57232, a vent 57234 for a chamber, and an extended tube 57238.

FIG. 58 shows a spacer similar to FIG. 55 but with a rounded top surface 58226 like in FIG. 54.

FIG. 59 shows a spacer similar to FIG. 49 but with a rounded top surface 59226 like FIG. 53 but with a smaller bend radius.

FIG. 60 shows a spacer similar to FIG. 47 except that its water line is well above the entire device, and the liquid surface 60126 attaches to two lips 60236 on each side of the device creating the desired convex meniscus 60128.

FIG. 61 shows a similar spacer 61146 with a lip 61226 on each side but with shape and a bulk density that allows it to have the horizontal liquid surface line 61126 intersect with the cross-section of the device, creating the desired convex meniscus 61128.

Operation—Spacers

The addition of the spacers in FIGS. 12-14 shows that even if the curvature of a container and the floating object cannot be modified, a specially designed spacer can be used to create the desired effect. When considering the design of the floating object, one could create an angled surface on the perimeter of the floating object to create the desired meniscus curvature, but for each of these devices, the buoyancy and therefore the liquid level will change as the fuel burns. The changing liquid level will require a larger floating object to keep an angled solid surface along its perimeter. The advantage of using a spacer with these devices is that as the fuel burns on the floating devices, the liquid level does not change relative to the spacer since it is detached and floating independently from the self-propelled floating device. As the liquid level changes, the height of the floating spacer moves with the liquid level as long as its density relative to the liquid stays the same. This way, if there is a specific solid angle needed to create the proper meniscus curvature, then that angle can be held constant and designed into a floating spacer without worry that the changing liquid level will change the meniscus curvature. Also, the spacer can allow the self-propelled floating device to function in a variety of liquid bodies and liquid containers, since the spacer isolates and protects the self-propelled floating device from other surface objects or curvatures.

Note that even though FIGS. 12-14 show concave menisci along the self-propelled floating device, and a convex meniscus along the spacer, the same above statements apply to a spacer that creates a concave meniscus around its inside perimeter if the self-propelled floating device has a convex meniscus along its perimeter.

It can also be noted that as the self-propelled device moves or rotates, it can cause the spacer to move with the device, or rotate due to viscous forces in the liquid and the repulsive capillary effect.

The floating spacer can also have its own blades that turn from an external heat source as shown in a perspective view in FIG. 1514.

The arrangement of such an embodiment is shown in FIG. 32, except that it is designed to operate so that multiple floating tea light devices 31134 can travel along a path created by spacers 31146. All that is needed is a specially shaped spacer 31147 which surrounds each self-propelled floating device tea light 31134 and creates repulsive forces between each adjacent object in contact with the liquid surface. Note that other shapes may be used to create this effect, but this example is here to show what is operationally possible to create with the ideas presented in this document.

FIG. 33 shows a similar arrangement, except that the self-propelled floating tea light devices 32134 are designed to stay pointed in the direction of the path created by the two spacer rails 32146 enabling all of the floating objects between the rails to travel along the path.

The spacers presented in FIGS. 47-61 operate similarly to other spacer devices mentioned previously with a circular cross-section except some are designed to create concave menisci and some are designed to create convex menisci with various materials, surface finishes, and coatings if required. Some devices can be made that the buoyancy created by the device is large enough that even if the entire device was completely submerged, the device would float with a buoyancy strong enough to break through the liquid surface. Some devices can be used to create the desired meniscus without special materials, angles, surface finishes or coatings because the liquid surface is attached to the edge of a lip as in FIGS. 60 and 61 instead of a surface at a specific angle. Some devices can be made out of materials denser than the liquid due to being held up by the liquids surface tension (like FIG. 60). Some spacers have the ability that if the user flips the spacer over 180 degrees, it functions just the same because it is symmetrical, such as FIGS. 47, 48, 52, 53. Some of the devices when flipped over can create the opposite curvature on the liquid surface such as FIGS. 49 and 50 creating a duel functionality. Some of the devices are designed to have rounded tops such as FIGS. 53, 58, 59 that counter intuitively allows the buoyancy of the object to break through the liquid surface more easily if submerged. FIG. 51 creates oppositely curved menisci on each side of the spacer, one concave 51130 and one convex 51128, which is useful for other embodiments mentioned. The spacer ring can be made of very little material as shown in FIGS. 47, 48, 49, 51, 54, 55, 56, 57, and 59. Spacers can be designed so that the liquid surface is in contact with the spacer on an angled surface, which is at an angle so that the equilibrium wetting angle of the liquid-air-solid system creates the desired curvature of the meniscus as shown in FIGS. 47-55, 58, and 59. The desired meniscus can be made more reliable by making the device function the same even if there is slight differences in buoyancy or density of the liquid when it is in operation by having an extended surface at the required angle such as can be seen in FIGS. 47-52, 54, 55, and 59. If changing the angle of the surface of the object does not create the desired effect, than surface textures, or coatings can be applied to the solid surface to change the equilibrium wetting angle, the receding wetting angle, or the advancing wetting angle of the particular liquid-air-solid or liquid-liquid-solid system thereby enabling the designer to create the desired meniscus curvature. The spacers shown in FIGS. 55, 56, and 57 are designed to allow an air bubble trapped below the spacer to aid in buoyancy. If the spacer is segmented like the devices in FIGS. 56, and 57, then the device can become more stable since the trapped air bubble cannot freely combine with other air bubbles and travel to one side of the device and potentially capsizing the entire device. The amount of air can be controlled when the device is placed on a liquid surface horizontally by adding an air vent 57234 and tube 57238 as in FIG. 57 which can help ensure each chamber has nearly equal amounts of air.

FIGS. 16-18—Tea Light Holders

FIG. 18 illustrates another embodiment which consists of a floating tea light holder 17154 and a tea light 17158. The floating tea light holder 17154 has a blade 17110 that can extend above the tea light 17158, bottom tea light supports 17152, side tea light supports 17150, and creates a concave meniscus 17130 on the liquid surface 17126 around the outside perimeter.

FIG. 1615 illustrates another embodiment that shows a similar floating tea light holder but with the tea light removed, and it is no longer on a liquid surface.

FIG. 1716 illustrates another embodiment similar to FIG. 1615 but which has two blades 16110, and an insertable support 16156 for the tea light.

Operation—Tea Light Holders

Once the tea light has been inserted into the tea light holder, the operation of the tea light holders is similar to previous embodiments. Note that the supports create minimal contact between the tea light and the holder which will be in direct contact with the liquid. This is important because it insulates the tea light (with the air gap between the tea light outer wall and the holder inner wall) which can possibly allow the tea light to melt more of its wax and possibly burn for a longer time since more wax can be melted.

FIGS. 18-21—Embodiments Using Multiple Wicks

FIGS. 19 and 20 illustrate in a perspective view and a view from the top respectively, an embodiment that consists of multiple wicks. The embodiment as shown in FIGS. 18 and 19 use a floating candle 18116 as its floating base where three wicks 18112 create individual melt pools in the solid wax fuel 18114. Blades 18110 are positioned above and bend over the wicks 18112 in a consistent rotational direction.

FIG. 21 illustrates in a perspective view a similar embodiment that is in the general shape of a torus.

FIG. 22 illustrates in a perspective view an embodiment that consists of self-propelled floating tea light devices 21134, self-propelled floating candles 21160, and spacer rings 21146 floating on a liquid surface 21126 within a container 21124. In this embodiment, the spacers 21146 are designed to create convex menisci on the liquid surface, and the self-propelled floating devices as well as the container are designed to create concave menisci on the liquid surface. Each self-propelled floating device has blades 21110 that point in consistent rotational direction within each self-propelled floating device, but need not be consistent in rotational direction with blades on other self-propelled floating devices.

Embodiments Using Multiple Wicks—Operation

The operation of the self-propelled floating wick devices as shown in FIGS. 19-22 are similar to other embodiments accept that multiple wicks can be lit. Note that because floating objects in FIG. 22 create concave menisci and the spacer rings create convex menisci directly adjacent to the floating objects, that each floating object is made to repel each other because their adjacent menisci are opposite in curvature.

FIGS. 22 and 23—Embodiment Using Chirality

FIGS. 23 and 24 illustrate respectively in a perspective view and a cross-sectional view from the side, an arrangement of another embodiment that consists of a right-handed self-propelled floating tea light device 22162 (designed to be clockwise spinning) and a left-handed self-propelled floating tea light device 22164 (designed to be counter-clockwise spinning) which both create concave menisci 22130 along their perimeter, and a spacer ring 22146 that creates a convex meniscus 22128 around its inside and outside perimeters that surrounds both self-propelled tea light devices. FIG. 24 also illustrates a container wall 22142 that creates a concave meniscus 22130 surrounding the spacer ring 22146.

Embodiment Using Chirality—Operation

The arrangements shown in FIGS. 23 and 24 operate in a similar manner as other embodiments, except that it is worth noting that because the two objects are designed to rotate in opposite directions, they will not cause friction between them on their outside wall, and will not fight each other for which rotational direction to spin even though they are attracted to one another due to the capillary force (cheerio effect).

FIGS. 25-28, 34, 35, 42—Additional Forms of Embodiments

FIGS. 25-28, 34, 35, and 42 illustrate other embodiments that are similar to those previously mentioned except that they are designed for more specific purposes, and are intended to show the enormous variability in the visual appearance of the disclosed invention.

FIGS. 25 and 26 illustrate in a perspective and a view from the top respectively of a self-propelled floating tea light device 24134 in the general shape of a sail boat. The sail boat shaped self-propelled floating tea light device 24134 is similar to other embodiments mentioned except that it has additional features, such as a keel 24166 which is connected to the bottom of the float body, mast 24168 which is connected to and extends out above the float body, boom 24172 connected to the mast 24168 and a sail 24170 that acts as a blade 24110 that is attached to the mast 24168 and boom 24172 and extends over top of the wick 24112. FIG. 25 shows how the blade 24110 can extend over a vertical air stream created by the wick 24112.

Similarly, FIGS. 27 and 28 illustrate other embodiments that are in the general shape of a catboat, which has additional features of a gaff 26176 connected to the mast 26168 and sail 26170 as well as a rudder 26174. FIG. 28 also shows a spacer ring 26146 that surrounds the self-propelled floating tea light device 26134 as well as a container wall 26142 which holds a liquid.

FIGS. 34 and 35 illustrate similar self-propelled floating candle devices to what has been shown in the first embodiment. FIG. 34 illustrates another embodiment of a self-propelled floating candle consisting of a floating body in the form of a floating candle 33116 which consists of a wick 33112 and solid fuel 33114 where a topper that consists of a support structure 33180 which is connected to blades 33110 that are positioned above the wick 33112. FIG. 35 illustrates another embodiment with the blades 34110 constructed in the general shape of a roof vent or whirly-bird. Also, shown in FIG. 35 is a counterweight 34144 connected to the floating candle 34116.

FIG. 42 illustrates another embodiment of a self-propelled floating oil lamp 42140 floating on a liquid surface. The device is similar to other self-propelled floating oil lamp devices mentioned previously except that its body is in the general shape and appearance of a holiday ornament.

Additional Forms of Embodiments—Operation

Operation of the embodiments illustrated in FIGS. 25-28, 34, 35, 42 are similar to other embodiments mentioned of similar type. It is worth mentioning that many of the engineering techniques used in the design of marine vessels are applicable to the design of self-propelled floating devices. This insight is useful in designing many aspects of the embodiments mentioned in this document. For example, the keel (24166, 26166) as shown in FIG. 25 and FIGS. 27 and 28, respectively, acts to stabilize the floating body by lowering its center of gravity relative to its center of buoyancy just as in a marine vessel. Also, the streamlined shape of the boats shown in FIGS. 25-28 help in lowering the resistance of the fluid when the object is in motion along a liquid surface.

Figure 37:
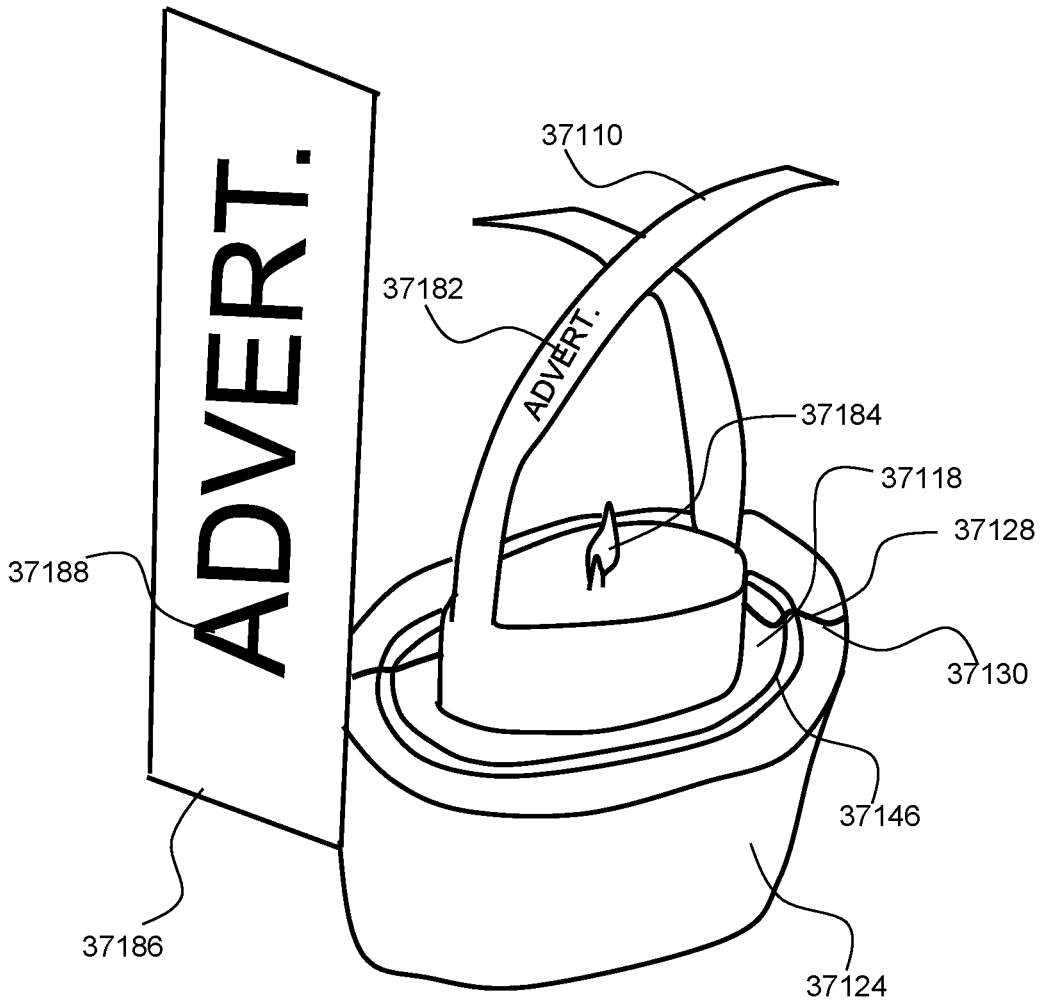

FIGS. 36-37—Projection

FIG. 36 illustrates in a perspective view another embodiment similar to FIG. 3. except that an advertisement 36182 is cut out of the blade 36110.

FIG. 37 illustrations in a perspective view another embodiment similar to FIG. 36 except that it has two blades 37110 where one has an advertisement 37182, whose projected image 37188 located on a surface 37186 external to the device but on the same line as the advertisement 37182 and the light source 37184.

Projection—Operation

The operation of other embodiments shown in FIGS. 36 and 37 are similar to the operation of other embodiments mentioned except that they have the have the additional function of using the heat source as a light source (36184, 37184) to project light onto the advertisement (36182, 37182) cut out from the blade (36110, 37110). The light as it travels in a line is partially reflected or absorbed by the blade (36110, 37110), and passes through the advertisement (36182, 37182). In FIG. 37 the light that passes through the advertisement 37182 takes the shape of the advertisement and is reflected, absorbed, or partially passes through the projection surface 37186 at the projected image 37188 in the shape of the advertisement 37188. Thus, if the device is rotating like other similar embodiments mentioned, the projected image 37188 of the advertisement will also move in the direction of the rotation along the projection surface 37186, creating a stunning effect.

FIG. 38—Embodiment Using Two Liquid Phases

FIG. 38 illustrates in a cross-sectional view from the side another embodiment of a self-propelled floating wick device 38120 in a container 38124 of two immiscible liquids. The container 38124 has an upper section with the extended wall 38138 that has a larger internal diameter than the other lower section of the container 38124. The upper liquid surface 38126 which is a fuel 38114 for the self-propelled floating wick 38120 creates a concave meniscus 38130 up against the container wall and the floating wick. The surface of the lower liquid between the two liquids creates a liquid-liquid interface 38192. The lower liquid 38190 creates a concave meniscus along the container walls 38142, and an extended lower piece of the self-propelled floating object 38120 where the extended lower piece also is a counter weight. There is also a spacer ring 38146 that floats on the lower liquid 38190 but sinks in the upper liquid fuel 38114 so that it settles on the interface. The spacer ring creates a convex meniscus 38128 on both its inside and outside perimeters on the surface of the lower liquid 38190. The self-propelled floating wick device has an extended rim 38194 that bulges out along its perimeter along the air-liquid interface 38126.

Embodiment Using Two Liquid Phases—Operation

The operation of the embodiment using two liquid phases is similar to the operation of other embodiments except for a few key ways. One way that is different is that air-liquid interface creates two concave menisci directed adjacent to each other which will attract one another. This attractive force is countered by the repulsive force generated at the liquid-liquid interface below caused in part by the spacer ring at the interface. Note that the self-propelled floating wick device can be made to be very stable and upright in the vertical direction due to the counter weight 38144 and the extended rim 38194. This in combination with the repulsive forces at the liquid-liquid interface keeps the self-propelled floating device from moving towards the container 38124 at the extended wall 38138 due to the attractive capillary forces acting as a result of the shape of the air-liquid interface. The device can also be designed so that the lower liquid is able to extinguish the flame when the upper liquid fuel is nearly consumed. Note that the lower section of the container 38124 must be made long enough to accommodate the self-propelled floating device so that the lower portion of the wick 38112 can reach the lower liquid surface 38192 as the fuel is consumed.

FIGS. 39 and 40—Embodiment with External Fuel

FIGS. 39 and 40 illustrate in a cross-sectional view from the side and a perspective view another embodiment similar to others except that it has the fuel separated from the self-propelled floating device. The FIGS. 39 and 40 show two containers holding two separate liquids, one outside container 39124, and one smaller inside container 39214. The self-propelled floating device floats on the liquid contained in the outside container and creates convex liquid menisci on its inside and outside perimeters on the liquid surface. Another difference is that the wick 39112 creates a concave meniscus on liquid surface 39126 in the inside container 39214 which also acts as a fuel 39114 for the wick 39112. Note there is an air vent 39122 similar to those of other self-propelled oil lamp embodiments presented earlier.

Embodiment with External Fuel—Operation

The operation of the embodiment presented in FIGS. 39 and 40 is similar to other embodiments accept that it must be designed so that attractive capillary force that acts on the wick and the inside container must be overcome by the repulsive capillary force that acts on the self-propelled floating device and either the inside container wall or the outside container wall.

FIG. 41—Embodiment with Container that is Internally Reflective

FIG. 41 illustrates another embodiment similar to other embodiments except that its container 41124 is designed to reflect light from a light source 41184 back onto the self-propelled floating device. The figure shows an embodiment that consists of a self-propelled floating oil lamp 41140 similar to those previously mentioned on the surface of a liquid 41126 surrounded by three spacer rings 41146 which are contained by a container 41124 in the shape of a prolate spheroid (also known as a 3D ellipse) with a hole cut out on top. Floating objects are designed to create menisci so that they will be repelled by what is adjacent to each other or a wall 41142 of the container 41124. The embodiment also has a support ring 41198 to prevent the container from tipping when placed on a level surface. Two light paths coming out from the light source are shown as dashed lines to show how the light would reflect off of the container wall and back on the self-propelled oil lamp device 41140. Note that the focal points 41200 of the prolate spheroid are located at the light source 41184 and on the self-propelled floating object 41140.

Embodiment with Container that is Internally Reflective—Operation

The operation of the embodiment in FIG. 41 is similar to other embodiments except that the container has the additional effect of reflecting light of the lamp back onto the lamp creating a stunning effect when spinning in the container.

FIGS. 43 and 44—Alternative Heat Source

FIGS. 43 and 44 illustrate in a perspective view other embodiments that are similar to other embodiments mentioned except that they create a heat source with a resister instead of a wick. FIG. 43 shows an embodiment similar to that presented in FIG. 3 except that the wick is replaced by a resister 43204 and connected in a circuit with a wire 43206 by a battery 43202 which replaces the fuel source.

FIG. 44 shows a similar embodiment except that its battery is replaced by an induction coil 44208 that is surrounded by another induction coil 44208 wrapped around the container 44124 connected to an AC power source 44210 in a circuit by a wire.

Alternative Heat Source—Operation

The device shown in FIG. 4 operates in much the same way as other similar embodiments except that the battery 43202 stores energy which can be converted into heat at the resistor 43204.

The embodiment shown in FIG. 44 operates similarly except that the resistor 44202 is powered by an induction coil 44208 which in turn is powered by the magnetic field generated by another induction coil on the container which is connected by wire in a circuit with an alternating current power source 44210.

FIGS. 45 and 46—Embodiment with Modified Candle Follower

FIG. 45 illustrates an embodiment in a cross-sectional view from the side of a self-propelled floating candle device 45148 similar to other embodiments of the same type and is placed on a liquid surface 45126 surrounded by a spacer ring 45146 within a container. The difference in this embodiment is that the self-propelled floating candle device 45148 whose main body consists of a pillar candle with decorations 45216 made up of a solid wax fuel 45114. The self-propelled floating candle device 45148 has a topper that is in the form of a modified candle follower 45220 with blades 45110 that when positioned on the pillar candle, the blades 45110 extend above the wick 45112. The self-propelled floating candle device 45148 also consists of a float buoyancy modifier piece 45218 that is of low bulk density or traps air and a counterweight 45144 at the bottom of the candle pillar.

FIG. 46 illustrates in a perspective view an embodiment of a modified candle follower with blades 46110 similar to that shown in FIG. 45 that consists of a candle follower base 46224 which is connected to a blade 46110 and has an opening 46222 for a wick.

Embodiment with Modified Candle Follower—Operation

The operation of the self-propelled candle device 45148 is similar to other embodiments of the same type except that the candle follower is capable of traveling down the candle as the solid wax fuel 45114 is consumed. The buoyancy modifier helps the device stay afloat and the counterweight helps to stabilize the candle in the liquid and therefore keeping it upright.

Thus, the reader will see that at least one embodiment of the device provides a more economical device that does not need to use magnets and has a much wider range of possible designs yet is very simple to use.

Note that many of the parts of the embodiments mentioned can be manufactured with commonly available materials such as wax, polypropylene, polyethylene, polylactic acid, metals such as aluminum, biomaterials such as wood, cotton fibers, paper, ceramics such as glass or porcelain etc., and manufactured by combinations of well understood methods, like stamping, punching, injection molding, 3D printing, lathe work, drilling, carving, cutting, sandblasting etc.

While my above description contains many specificities, these should not be construed as limitations on the scope, but rather as an exemplification of one or several embodiments thereof. Many other variations are possible. For example, here is a small listing of other embodiments based on the ideas presented in this document:

Many of the embodiments can be slightly modified to either create a device that moves linearly, moves rotationally, or with a combination of both forms of movement based on the shape of the blades above the heat source.

Modified floating wick bodies can be made hollow to help in buoyancy and vented to allow expansion of air when heated by a lit flame.

Oil lamps and similar devices can have extra features that are common to those devices such as wick height adjustment features, or mechanisms to extinguish the flame when tilted.

Wicks can take multiple forms such as circular like an argand lamp.

The use of container shapes like bowls to create desired meniscus

Devices such as the tea light holders can also be designed to hold candles or other wick holding devices of various shapes and sizes, not just tea lights.

With embodiments using multiple wicks, the wicks can be replaced by other sources of heat (such as a resistor) or cold (thermoelectric device).

Devices with multiple wicks could be constructed out of a floating material that holds tea lights, candles, or oil lamps.

Projection devices as shown in FIGS. 36, 37 can be modified to use different materials with different optical properties (for both the advertisement and object holding the advertisement); the projection surface can be various things, such a wall or a translucent paper bag.

The advertisement does not have to be on the blade, it could be on another object attached to the floating device which is not the blade or part of the floating device itself Advertisements can be added to many of the objects presented in various ways, which is significant because the motion created by the heat source draws the eyes of people because of the stunning effect.

The spacer ring in FIG. 38 could be removed if the liquid-liquid interface creates opposite curvatures of the menisci against the self-propelled floating wick device and the container wall.

The reflective container in FIG. 41 does not need to be in the general shape of a prolate spheroid, it could be other shapes with open tops such as a spherical, or cylindrical, or a prism with the base of a star etc.

Spacer design techniques (such as angled surfaces, lips, material selection, material finishes, surface coatings) to create a specific liquid curvature can be applied to other parts such as the floating body, container or other objects in contact with the liquid surface to achieve the desired effect of repulsion.

Spacers do not have to be in the general shapes of rings or rails, they could be various shapes, and those various shapes can perform various specific functions. For example, one could make a spacer in the general shape of an outline of a gear which has a cross-section similar to what has been mentioned previously. This gear could be turned by a self-propelled floating object without directly coming into contact because of the viscous forces of the floating fluid created when the floating object turns, and this gear could turn another gear. Thus the work from the self-propelled floating object can be transferred to other objects.

Accordingly, the scope should be determined not by the embodiments illustrated, but by the appended claims and their legal equivalents.

What is claimed is:

1. A device for steering toward a central area a heat source that floats on a liquid and is repelled away from an outer region of the liquid, the device comprising:

an outer object, at least one heat-source container configured to float on the surface of a liquid, at least one structure connected to the heat-source container;

the outer object comprising a floating ring configured to create, through surface tension, a first meniscus on the liquid surface along at least one wall of the outer object;

the heat-source container configured to create, through surface tension, a second meniscus on the liquid surface along the outer perimeter of the heat-source container wherein the curvature of the second meniscus opposes the curvature of the first meniscus in order to create resistance that inhibits the heat-source container from moving horizontally toward the outer object;

the structure connected to the heat-source container configured to allow a heat source to be placed beneath part of the structure wherein the structure generates a horizontal force as heat rises from the heat source and creates a vertical thermal air flow that impinges on the structure and causes the thermal air flow to be redirected to a partially horizontal thermal air flow that generates the horizontal force that causes the floating part to move.

2. The device of claim 1, configured to create the second meniscus with convex curvature and the first meniscus with an opposing concave curvature.

3. The device of claim 1, configured to create the second meniscus with concave curvature and the first meniscus with an opposing convex curvature.

4. The device of claim 1, wherein the material of the outer perimeter of the heat-source container is selected from the group consisting of: aluminum, wax, glass, borosilicate glass, brass, bronze, steel, stainless steel, wood, acrylic polymer, polyurethane, polypropylene, polystyrene, polytetrafluoroethylene.

5. The device of claim 1, wherein the material of the at least one wall of the outer object is selected from the group consisting of: aluminum, glass, borosilicate glass, brass, bronze, steel, stainless steel, wood, acrylic polymer, polyurethane, polypropylene, polystyrene, polytetrafluoroethylene.

6. The device of claim 1, wherein the outer object comprises the inner walls of a container for containing the liquid.

7. The device of claim 1, wherein the second meniscus is convex and the opposing curvature of the first meniscus is concave.

8. The device of claim 1, wherein the second meniscus is concave and the opposing curvature of the first meniscus is convex.

9. A device for steering toward a central area a heat source that floats on a liquid and is repelled away from a repelling object, the device comprising:

at least one heat-source container configured to float on the surface of a liquid, at least one structure connected to the heat-source container, at least one repelling object configured to be attached to an inner wall of an outer container at a vertical position that will coincide with the surface level of the liquid, and create, through surface tension, a first meniscus on the surface of the liquid and configured horizontally to influence the horizontal position of the heat-source container;

the heat-source container configured to create, through surface tension, a second meniscus on the liquid surface along the outer perimeter of the heat-source container;

the structure connected to the heat-source container configured to allow a heat source to be placed beneath part of the structure wherein the structure generates a horizontal force as heat rises from the heat source and creates a vertical thermal air flow that impinges on the structure and causes the thermal air flow to be redirected to a partially horizontal thermal air flow that generates the horizontal force that causes the floating part to move;

the repelling object configured to create the first meniscus wherein the curvature of the first meniscus opposes the curvature of the second meniscus in order to create resistance that inhibits the heat-source container from moving horizontally toward the repelling object.

10. The device of claim 9, wherein the liquid is selected from the group consisting of: water, salt water, oil, lamp oil.

11. The device of claim 9, wherein the heat source is selected from the group consisting of: a lit candle including candle wax and one or more wicks, a lit oil lamp including lamp oil and one or more wicks, a lit tea light, a lit wick, a resistor.

12. The device of claim 9, wherein the heat source container is configured to have a cross sectional shape in the form of a hull for the portion of the container intended to be submerged.

13. The device of claim 9, wherein the heat source container is configured to have a counter weight to lower its center of gravity.

14. The device of claim 9, wherein the repelling object is comprised of a material selected from the group consisting of: polypropylene, wax, wood, polytetrafluoroethylene, silicone rubber, polystyrene, polyethylene, acrylic polymer, polyurethane, aluminum, glass, borosilicate glass.

15. The device of claim 9, wherein the repelling object is configured to have the general shape of a torus with a cross sectional in a shape selected from the group consisting of: rhombus, square tilted 45 degrees, circle, American football, triangle, rhombus with rounded edges, square tilted 45 degrees with rounded edges, triangle with rounded edges.

16. The device of claim 9, wherein the structure is comprised of a material selected from the group consisting of: aluminum, glass, borosilicate glass, silicone rubber, brass, bronze, wood, thermoset plastic, feather, leaf, flower petal.

17. The device of claim 9, wherein the structure is configured in the shape of one or more blades.

* * * * *